US005355151A

United States Patent [19]

Yoshida et al.

[11] Patent Number: 5,355,151

[45] Date of Patent: Oct. 11, 1994

[54] IMAGE RECORDING APPARATUS AND METHOD IN WHICH RECORDING DATA INTERRUPTIONS ARE REDUCED

[75] Inventors: Takehiro Yoshida, Tokyo; Yukio Nohata, Yokohama, both of Japan

[73] Assignee: Canon Kabushiki Kaisha, Tokyo, Japan

[21] Appl. No.: 862,417

[22] Filed: Apr. 2, 1992

[30] Foreign Application Priority Data

Apr. 19, 1991 [JP] Japan ..... 3-088784

[51] Int. Cl.[5] ..... B41J 2/325

[52] U.S. Cl. ..... 347/61; 346/76 PH; 358/296

[58] Field of Search ..... 358/296; 346/76 PH, 346/1.1; 400/120

[56] References Cited

U.S. PATENT DOCUMENTS 4,456,392 6/1984 Nozaki et al. ..... 400/120
5,122,882 6/1992 Ishida et al. ..... 358/296
5,193,007 3/1993 Yokoyama et al. ..... 358/296
5,204,692 4/1993 Awai et al. ..... 346/76 PH

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

An image recording apparatus having a thermal transfer type printer for recording images based on received information on recording medium using an ink supplied by an ink sheet. The apparatus also has a memory device for storing print data containing data of a predetermined number of lines to be printed, on the basis of the speed of conversion of received information into dot data into independent line dot data and the speed of printing of one line dot data, a feeding mechanism for causing relative motion between the recording paper and the ink ribbon, and a data output device for outputting print data read from the memory device on a line by line basis at a constant time interval between successive lines and for delivering the output print data to the thermal transfer printer.

14 Claims, 22 Drawing Sheets

LINECTL
(S18)

S122
(SSBF1) = 0
NO
YES
S124
(SSBF0LINE) ←
(SSBF0LINE) +1
S146
(SSBF1LINE) ←
(SSBF1LINE) +1
S126
NO
(SSBF0LINE)
=256
S148
(SSBF1LINE)
=256
NO
YES
S128
(SSBF0FULL) ← 1
YES
S150
(SSBF1FULL) ← 1
S130
(SSBF1) ← 1
(SSBF1) ← 0
S152
(LINEADI) ← 0
S132
(LINEADIW) ← 0
S134
RETURN
(SSBCNT) ← 16
S138
(LINEADI) ←
(LINEADI) +100(H)
S140
(LINEADIW) ←
(LINEADI)
S142
RETURN

FIG. 21

| | tpr | taft | tpix |
|---|---|---|---|
| INITIAL LINE | 0.08 ms | (0.03ms ~ 0.06ms) | 1.2(0.02ms ~ 0.11ms) |
| OTHER LINES | 0.06 ms | (0.03ms ~ 0.06ms) | (0.02ms ~ 0.11ms) |
| LAST LINE | 0.04 ms | (0.03ms ~ 0.06ms) | 0.8(0.02ms ~ 0.11ms) |

(VALUES IN ( ) ARE FUNCTIONS OF TEMP.
THE LOWER THE TEMPERATURE,
THE LONGER THE TIME)

IMAGE RECORDING APPARATUS AND METHOD IN WHICH RECORDING DATA INTERRUPTIONS ARE REDUCED

BACKGROUND OF THE INVENTION

Field of the Invention

The present invention relates to an image recording apparatus which generates a predetermined amount of line data in accordance with image information and which uses this line data to record an image on a recording medium, thereby recording the image.

A facsimile apparatus having thermal transfer printing means is one known type of such an image recording apparatus. This facsimile apparatus intermittently records whereby data for one line is recorded each time one line's worth of data has been generated from received information and transferred to a line recording head. Consequently, recording interval between recording one line and recording the next line will vary according to the quantity of coded line data. In fact, the recording interval frequently varies by three orders of magnitude, from as little as several milliseconds to as much as several seconds. Therefore, various measures are taken in regard to application of heat after the completion of one-line recording, such as post-heating, in order that all lines will be recorded under uniform and optimum rate of application of heat.

It is, however, not easy to optimize the rate at which recording heat energy is applied for each of line of recording regardless of the varying time intervals between successive recording lines. In addition, image quality tends to be degraded by such irregular operation, as when, for example, sticking occurs as a result of irregular operation of the recording paper feed motor, which irregular operation may be caused by the variations in the recording interval.

A recording method known as the "multi-print method", employs a type of ink sheet known as the "multi-print sheet" which is usable "n" times. For performing a continuous recording over a length L, the multi-print sheet is fed by a distance which is smaller than L either during or after image recording. The length of feed of the multi-print sheet is represented by L/n, n being greater than 1. In use, the ink layer on the ink sheet is subjected to "n" cycles of heating, so that a portion of the ink layer is melted in each heating cycle, and the melted portion of the ink sheet is transferred to the recording paper due to the shearing force between the melted portion of the ink and the portion of the ink which has not been melted. The discontinuous motor operation due to the above-mentioned variations in the recording intervals causes a change in the shearing force between the melted and solid portions of the ink, depending the quality of the recorded image due to, for instance, sticking.

When the time interval between the recording of one line and the recording of the next line is long, the ink temperature is lowered so that the shearing force needed to separate the melted portion of the ink from the solid portion is increased making it more difficult to separate the ink sheet from the recording paper.

A recording method also is known in which heat-sensitive recording paper is selectively heated by a thermal head which is energized in accordance with image signals, so that selected portions of the heat-sensitive recording paper change color, recording the information. Another known method is the "single print method" which employs an ink sheet composed of a base film and a layer of thermally fusible ink applied to the base film, the ink sheet being selectively heated by a thermal head so as to melt and transfer the ink to the recording paper. The problems just described in connection with the multi-printing method are also encountered with these recording methods, although they may be less not serious than in the case of multi-printing method. The above-mentioned problems caused by the variations in the recording time interval are also encountered in other types of recording systems such as, for example, ink jet printers in which information is recorded by a jet of ink droplets, the ink being driven by a change in the state of the ink which is caused by boiling the ink by the selective application of heat, since such intermittent recording requires intricate controls of heating and feed of the recording medium, again degrading the recorded image quality.

SUMMARY OF THE INVENTION

Accordingly, an object of the present invention is to provide an improved image recording apparatus.

Another object of the present invention is to provide an image recording apparatus in which image quality is not degraded, regardless of recording speed.

Still another object of the present invention is to provide an image recording apparatus which can record at a constant speed.

A further object of the present invention is to provide an image recording apparatus which is capable of recording consecutive lines with a constant time interval between successive lines.

The above and other objects, features and advantages of the present invention will become clear from the following description of the preferred embodiments taken in conjunction with the accompanying drawings.

BRIEF DESCRIPTION OF THE DRAWINGS

FIG. 21 depicts widths (or durations) of heating pulses corresponding to different lines of recording in an embodiment of the present invention;

DESCRIPTION OF THE PREFERRED EMBODIMENTS

A facsimile apparatus having a thermal transfer type printing device will be described as a preferred embodiment of the present invention and will therefore be described in detail with reference to the drawings. It is to be understood, however, that the present invention can be applied to a variety of different image forming devices which record or print information using heat energy, such as a printer which uses heat-sensitive paper and an ink jet printer which discharges ink in response to changes in the state of the ink caused by boiling the ink, this boiling being triggered by the application of heat energy. The image recording apparatus of the present invention can be used in various applications such as wordprocessors, typewriters and so forth, as well as a facsimile apparatus which will now be described.

Figure 1:
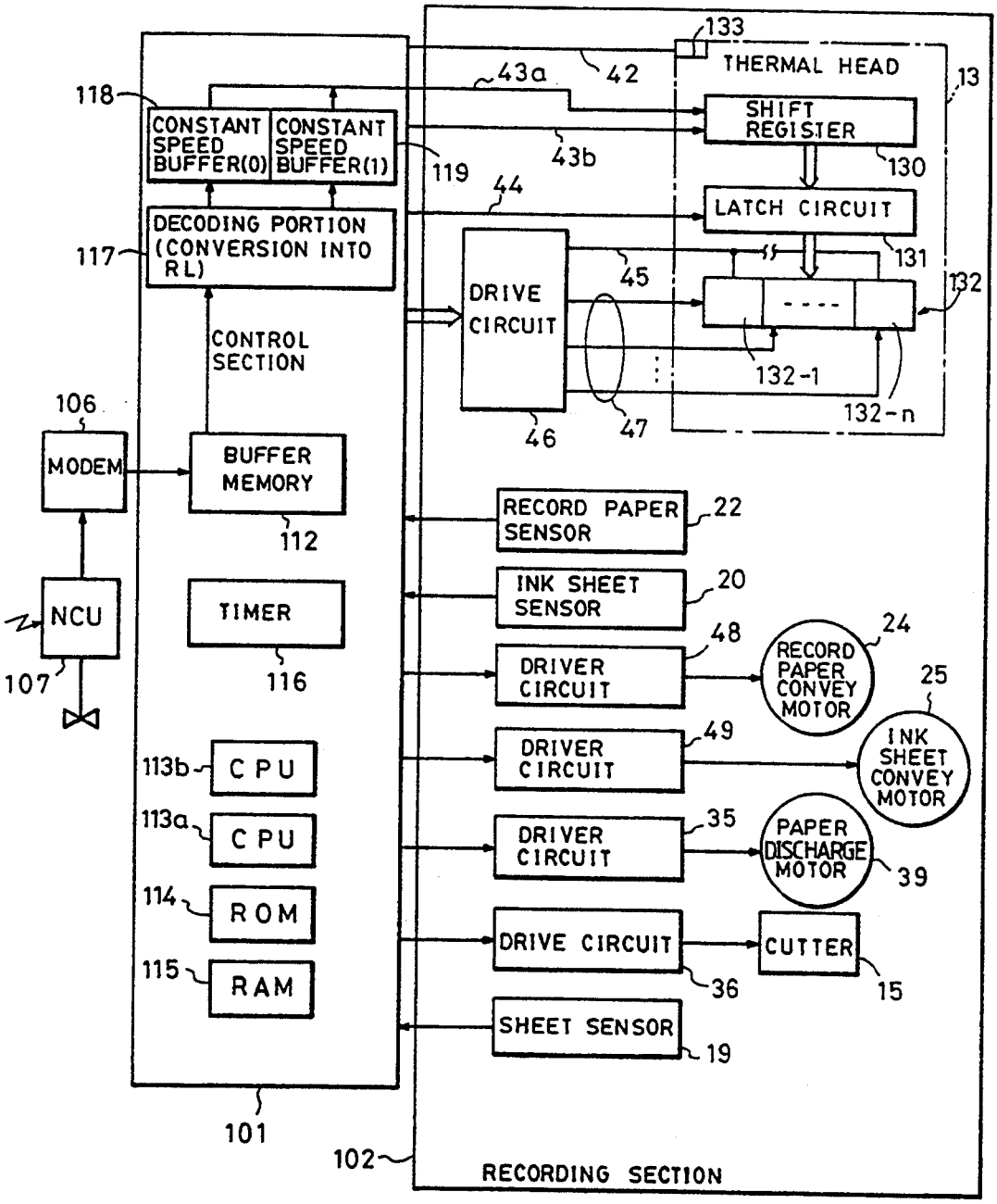
FIG. 1 is an illustration of electrical connections between a control section and a recording section of an embodiment of the present invention.
Figure 2:
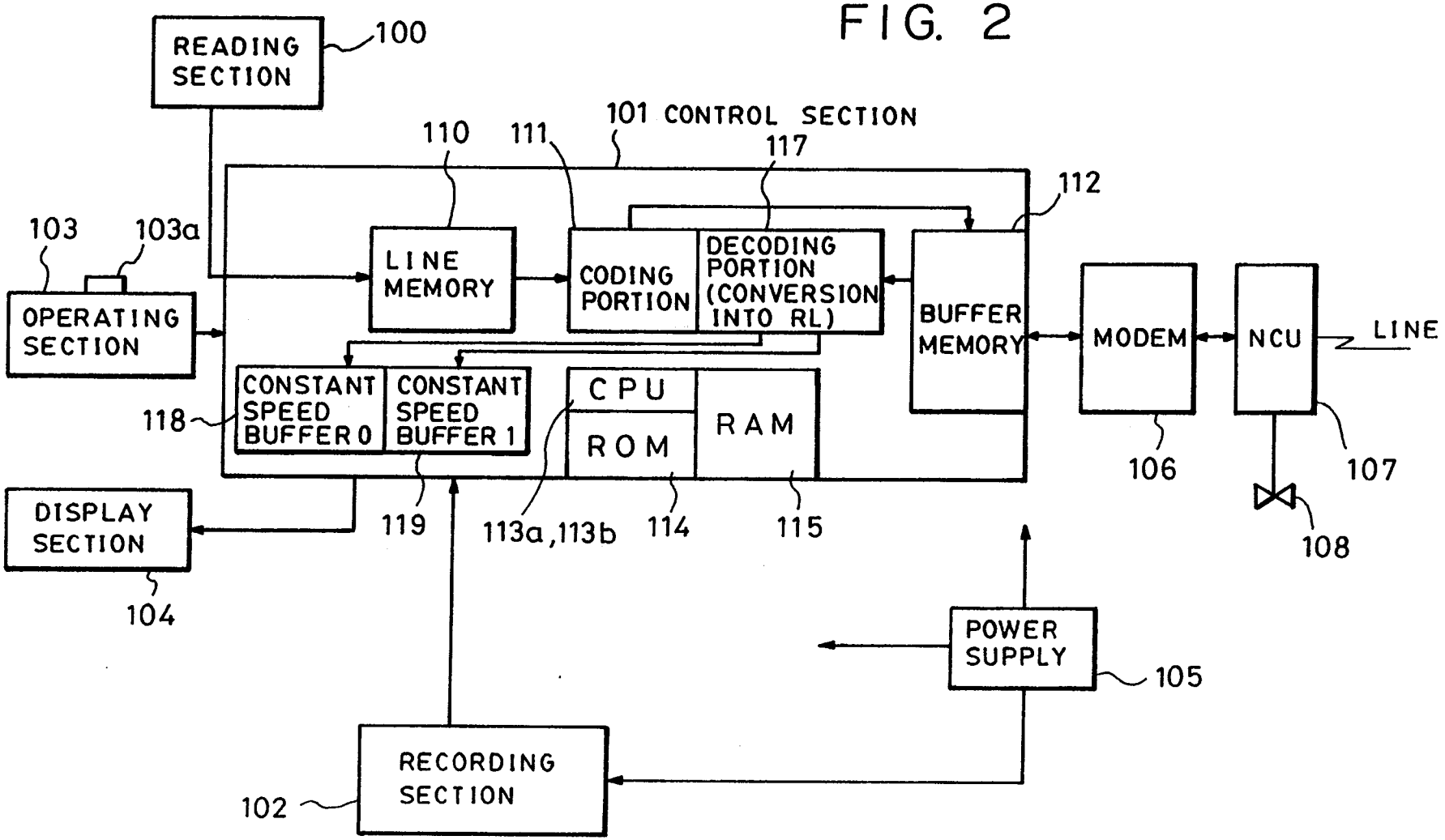
FIG. 2 is a schematic block diagram showing the construction of a facsimile apparatus embodying the present invention.
Figure 3:
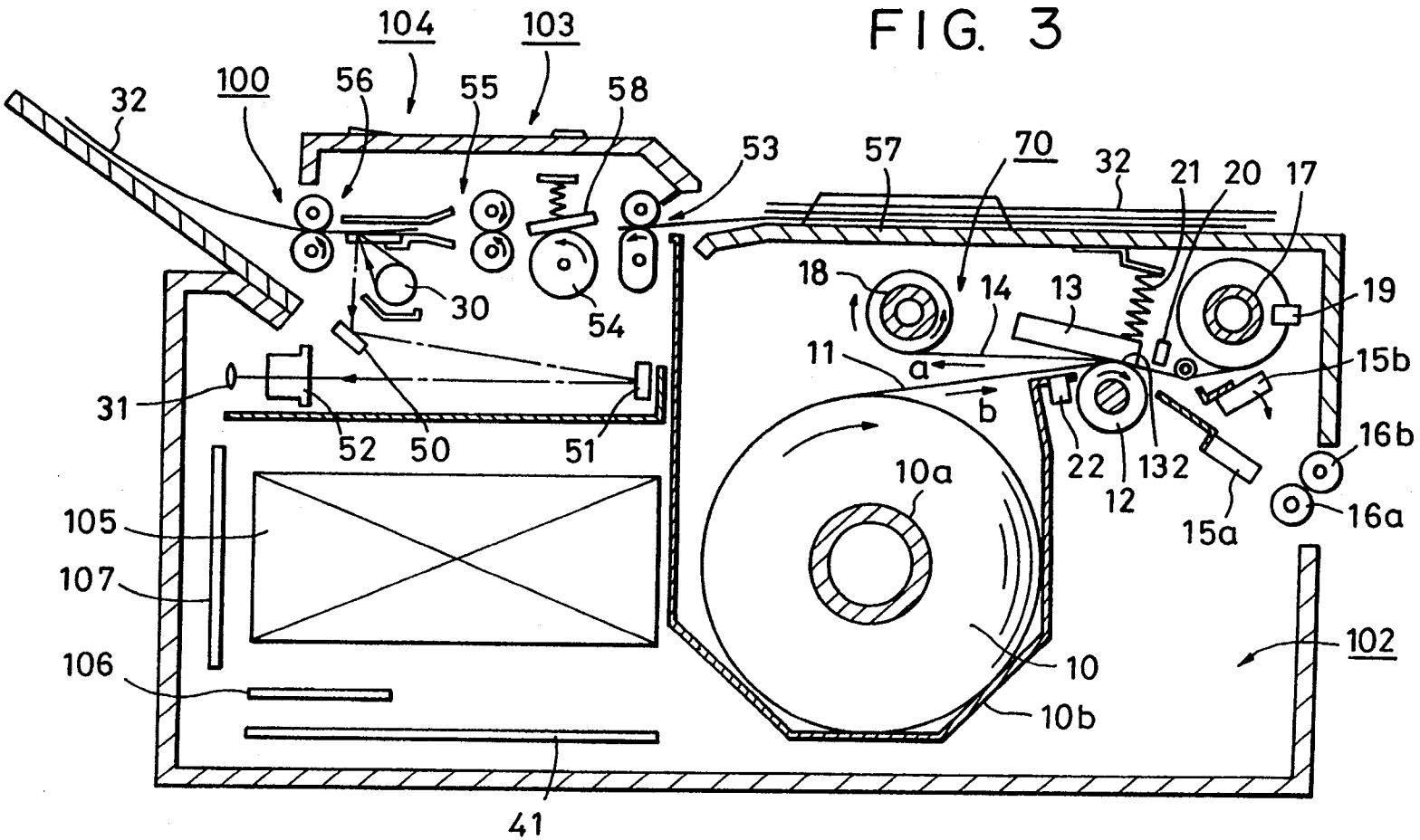
FIG. 3 is a sectional side elevational view of the facsimile apparatus shown in FIG. 2, illustrating the internal mechanical construction.
Figure 4:
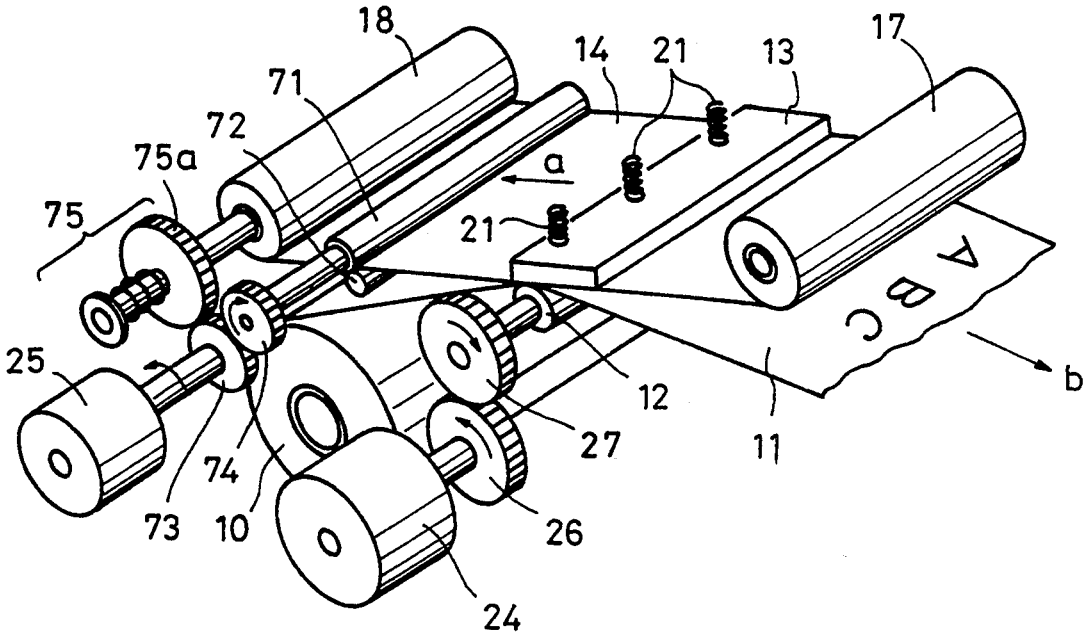
FIG. 4 is an illustration of systems for feeding the ink sheet and the recording paper.

The advantages of the present invention will be most remarkably enjoyed when the invention is applied to a facsimile apparatus of the type shown in FIGS. 1 to 4 having a thermal transfer type printing device. FIG. 1 shows electrical connections between a control section 101 and a recording section 102 of the facsimile apparatus, FIG. 2 is a schematic block diagram showing the construction of the facsimile apparatus, FIG. 3 is a side elevational view of the facsimile apparatus, and FIG. 4 illustrates systems for feeding recording paper and the ink sheet.

The construction of the whole facsimile apparatus will be described with specific reference to FIG. 2. The facsimile apparatus has a reading section 100 which electro-optically reads an original and delivers digital image signals to the control section 101. The reading section 100 has an original feeding motor, a CCD sensor and so forth.

Referring now to the control section 101, this section 101 has a line memory 110 for storing image data for each line of recording. When the facsimile apparatus is operating in transmission mode to transmit an original image or in a copy mode for copying the original image, the line memory 110 stores data corresponding to one line of image recording acquired from the digital image signals from the reading section 100. Coding section 111 codes the image information to be transmitted using, for example, MH coding. A buffer memory 112 stores coded image data which is to be transmitted or received. A decoding section 117 decodes received coded image data into run length data (referred to as "RL" hereafter).

In the embodiment described, the RL data is converted into dot data (referred to also as "green data") by a software control and the dot data are stored either in a constant speed buffer 118 or a constant speed buffer 119. In this embodiment, each of the constant speed buffers 1 and 0 has a memory capacity of 2048×256 bits, which corresponds to 256 lines of recording. This facsimile apparatus is intended to record image information selectively on either A-4 or B-4 size paper. Thus, each of the constant speed buffer 0 and the constant speed buffer 1 stores green data corresponding to 256 lines of recording. The above-described sections in the control section 101 operate under the control of a CPU 113*a* such as a microprocessor. The control section 101 further includes another CPU 113*b* which controls the recording section 102 and which operates in parallel with the CPU 113*a*, a ROM 114 which stores control programs for the CPU's 113*a*, 113*b* and other data, a RAM 115 which serves as a work area for the CPU's 113*a*, 113*b* and temporarily stores various data, and so forth.

The recording section 102 has a thermal line head of thermal transfer recording type and is capable of recording, at a constant speed, the image information of 256 lines stored in the constant speed buffer 0 or the constant speed buffer 1. The construction of the recording section 102 will be described later in greater detail with reference to FIG. 3.

An operating section 103 has function keys for selecting various functions such as starting transmission, as well as numeral keys used for entering telephone numbers. A switch 103*a* in operating section 103 is used to indicate the type of ink sheet used being used. When a multi-print ink sheet is used, this switch 103*a* is turned on, whereas when an ordinary ink sheet used, this switch is turned off. Detection of the type (characteristics) of the ink sheet 14 may, however, be performed automatically by sensing a mark printed on a portion of the ink sheet 14 or a mark or a sign such as a notch or projection provided on the cartridge housing the ink sheet.

Numeral 104 denotes a display section which, in most cases, is disposed adjacent the operating section 103 and which displays various functions and states of the apparatus. The whole apparatus is supplied with electrical power from a power supply section 105. Numeral 106 denotes a MODEM, 107 denotes a network control unit (NCU) and 108 denotes a telephone.

The construction of the recording section 102 will be described in detail with reference to FIG. 3. In FIG. 3, the same reference numerals are used to denote the same parts or components also shown in FIG. 2.

Referring to FIG. 3, a recording paper which is an ordinary plain paper 11 is rolled on a core 10*a* to form a paper roll 10. The core 10*a* is rotatably disposed in the apparatus so that the recording paper 11 is fed to a recording region under a thermal head 13 in accordance with the rotation of a platen roller 12 as indicated by the arrow. Numeral 10*b* designates a paper roll mounting section in which the paper roll 10 is detachably mounted. The platen roller 12 feeds the recording paper 11 in the direction of arrow b and cooperates with a heat-generating member 132 of the thermal head 13 to press therebetween the recording paper 11 and an ink sheet 14 placed on the paper. In operation, the thermal head 13 is energized to generate heat so that the ink is selectively transferred to the recording paper 11, thereby to recording image information. The recording paper 11 is then fed towards discharge rollers 16*a*, 16*b* (collectively referred to as "discharge rollers 16") by further rotation of the platen roller 12 and, when recording of one page's worth of data is finished, cutter edges 15*a*, 15*b* (collectively referred to as "cutter 15") are moved, severing the paper on which the image information has been recorded.

The ink sheet 14 is stretched between an ink sheet supply roll 17 on which the ink sheet is wound and an ink take-up roll 18 which is driven by an ink sheet feed motor (to be discussed later) so as to take up the ink sheet 14 in the direction of an arrow "a". The ink sheet supply roll 17 and the ink sheet take-up roll 18 are detachably mounted in an ink sheet loading section 70 provided in the body of the apparatus. A sensor 19 senses the length of the remaining ink sheet 14 and the speed at which the ink sheet 14 is fed. Springs 21 urge the thermal head 13 towards the platen roller 12, thereby pressing together the recording paper 11 and the ink sheet 14 nipped therebetween. A recording paper sensor 22 senses whether a recording paper exists or not.

Next, the reading section 100 will be described. Referring to the drawings, numeral 30 designates a light source for illuminating an original 32. The light reflected by the original 32 impinges upon a CCD sensor 31 through an optical system including mirrors 50, 51 and a lens 52, and is changed by the CCD sensor into electrical signals. The original 32 is fed by original feed rollers 53, 54, 55 and 56 which are driven by an original feed motor (not shown), in synchronization with the reading of the original by the reading section 32. Numeral 57 designates an original table which holds a stack of original sheets 32 which are individually fed therefrom by the cooperation between the feed roller 54 and a separator 58, and are successively fed into the reading section 100.

The major portion of the control section 101 is built up on a control circuit board 41 from which various control signals are delivered to various sections of the apparatus. Numeral 106 and 107 respectively denote a modem circuit board unit and an NCU circuit board unit.

FIG. 4 shows the details of the systems for feeding the ink sheet 14 and the recording paper 11. As will be seen from this figure, recording paper feed motor 24 drives the platen roller 12 so as to feed the recording paper 11 in the direction of arrow b which is the reverse of the arrow a. Ink sheet feed motor 25 drives a capstan roller 71 which cooperates with a pinch roller 72 so as to feed the ink sheet 14 in the direction of arrow a. Transmission gears 26, 27 transmit the torque of the recording paper feed motor 24 to the platen roller 12, while transmission gears 73, 74 transmit the torque of the ink sheet feed motor to the capstan roller 71. Numeral 75 designates a slip clutch unit.

The ink sheet 14 fed by the capstan roller 71 is securely taken up by the take-up roll 18, because the ratio of gear teeth between the gear 73 and the gear 74 is chosen such that the length of the ink sheet 14 taken up by the take-up roller 18 is slightly greater than the length of the ink sheet fed by the capstan roller 71. The difference between the length of the ink sheet 14 taken up by the take-up roll 18 and the length of the ink sheet 14 fed by the capstan roller 71 is absorbed by the slip clutch unit 75. With this arrangement, it is possible to prevent any change in the rate (speed) of feed of the ink sheet 14 which may otherwise be caused by charges in the diameter of the roll of the ink sheet 14 which accumulates on the take-up roll 18.

FIG. 1 shows electrical connections between receiving section (NCU 107, MODEM 106), control section 101 and recording section 102 of the facsimile apparatus. In this Figure, the same reference numerals are used to denote parts or members which have appeared in other figures.

The thermal head 13, which here is a line printhead, has a shift register 130 for receiving one-line serial record data 43*a* and shift clock signals 43*b* from the control section 101, a latch circuit 131 which latches the data in the shift register 130 in response to a latch signal 44, and a heat-generating device (heat-generating resistor) 132 having a single line of selectively-drivable heat-generating resistor elements. The heat-generating elements 132 are divided into blocks 132-1 to 132-n and are driven on the basis of these blocks.

Temperature sensor 133 senses the temperature of the thermal head 13 and produces an output signal 42 which is A/D converted in the control section 101. The digital signals thus obtained are delivered to the aforesaid CPU 113*b*. Thus, the CPU 113*b* detects the temperature of the thermal head 13 and operates to optimally vary the amount of energy supplied to the thermal head 13 by varying the pulse width of a strobe signal 47 and the driving voltage of the thermal head 13, also taking into account the characteristics of the ink sheet 14. Numeral 116 denotes a programmable timer which counts time on a 10 millisecond basis, for example, to enable constant-speed recording. The unit of time to be counted is set by the CPU 113*a* and the time counting is commenced in response to a time counting instruction. The timer 116 operates to deliver an interrupt signal to the CPU 113*a* each time the set time (10 ms) is counted.

A drive circuit 46 receives a drive signal for driving the thermal head 13 delivered from the control section 101 and produces the strobe signal 47 for driving the thermal head on the block basis. In response to instructions given by the control section 101, the drive circuit 46 changes the output voltage delivered to a power supply 45 which supplies electrical power to the heat-generating elements 132 on the thermal head 13, thereby changing and optimizing the rate of supply of the energy to the thermal head 13. A cutter driver circuit 36 includes a cutter driving motor and other parts for activating the cutter 15. Paper ejection motor 39 drives the paper ejection rollers 16. Numerals 35, 48 and 49 denote, respectively, driver circuits for driving a paper ejection motor 39, a recording paper feed motor 24 and an ink sheet feed motor 25. In the illustrated embodiments, stepping motors are used for the paper ejection motor 39, the recording paper feed motor 24 and the ink sheet feed motor 25, although other types of motors such as D.C. motors can also be used.

Figure 5:
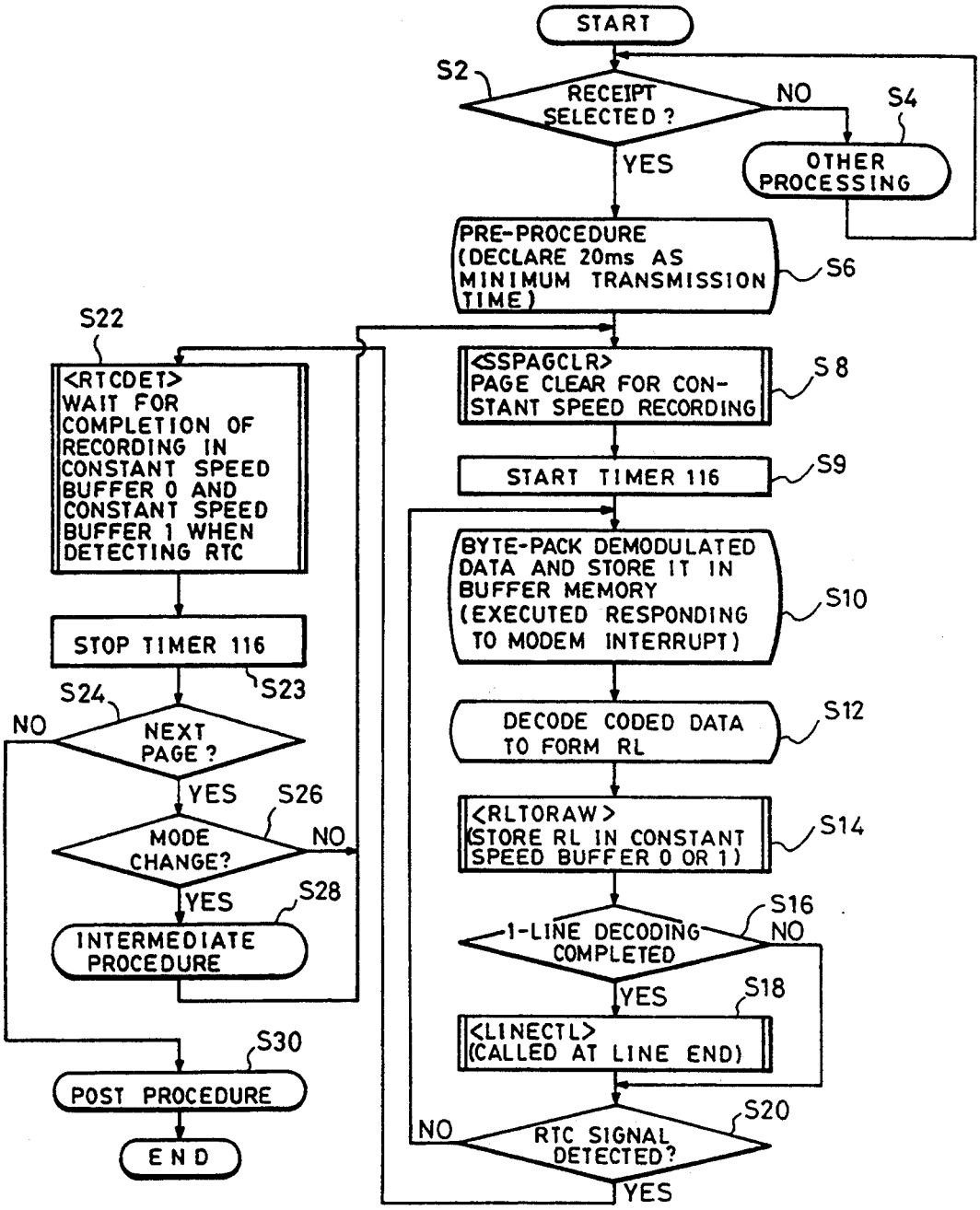
FIGS. 5 to 19 are flow charts showing signal receiving and processing processes in an embodiment of the present invention.

The recording operation will next be described. FIG. 5 is a flow chart showing the recording processing performed in the facsimile apparatus. This process is executed under the control of a control program which is stored in the ROM 114 of the control section 101.

Figure 9:
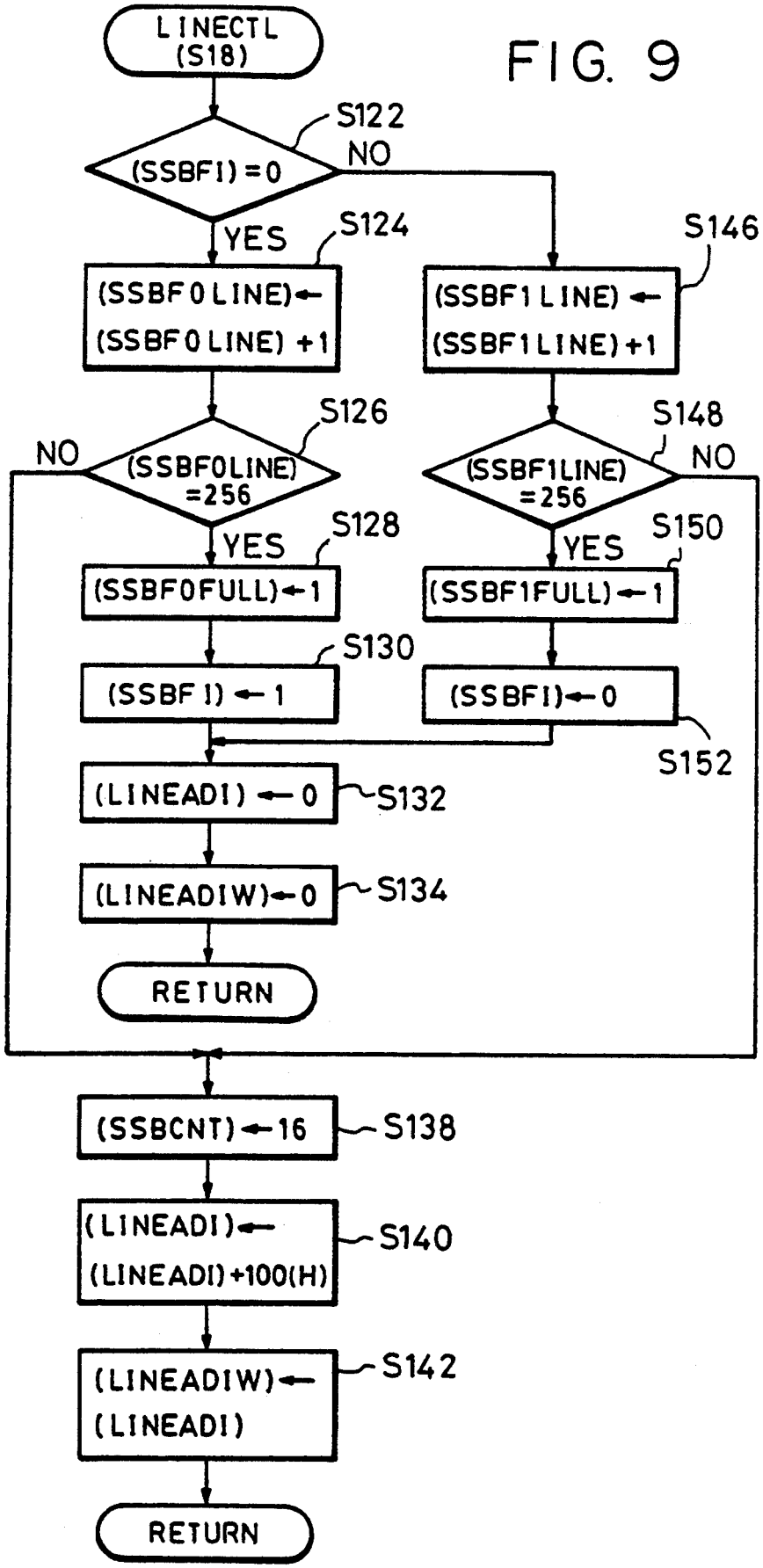
Figure 10:
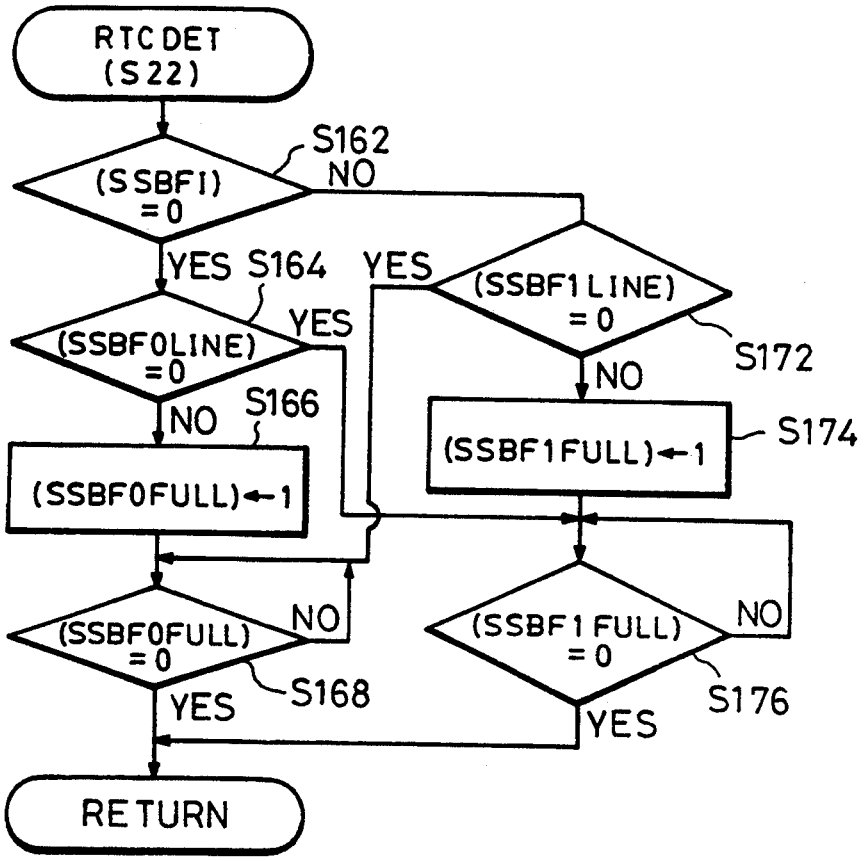
Figure 11:
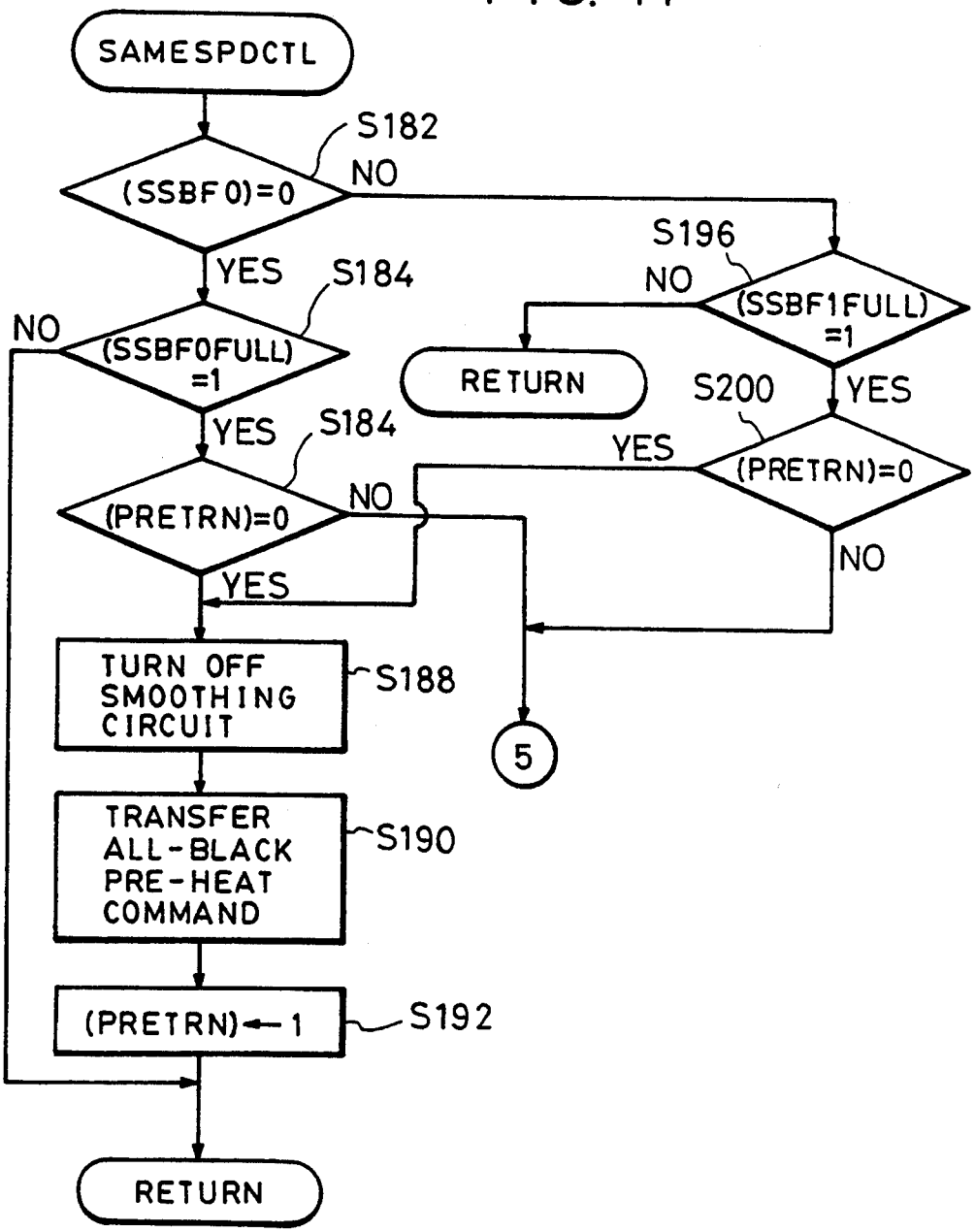
Figure 12:
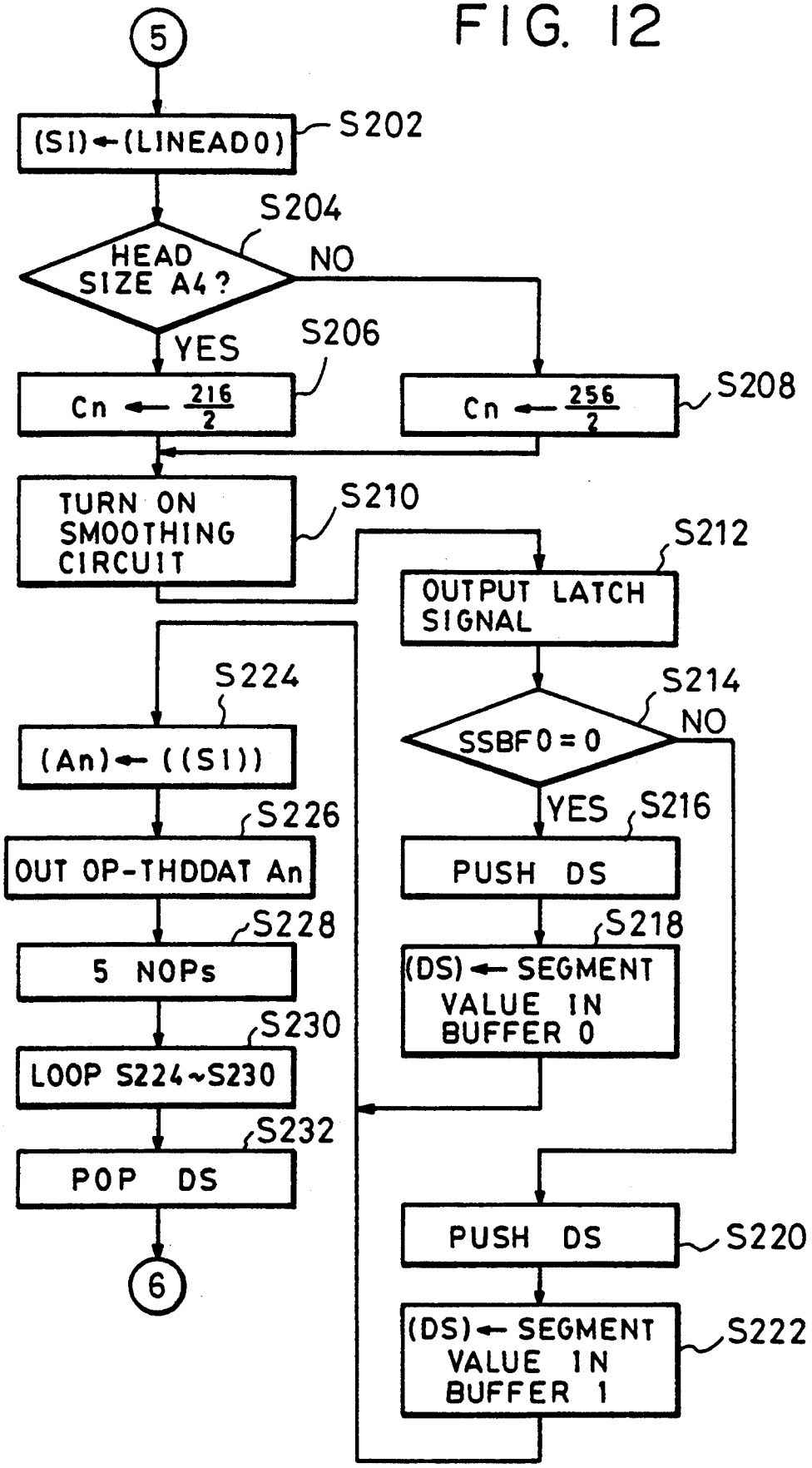
Figure 13:
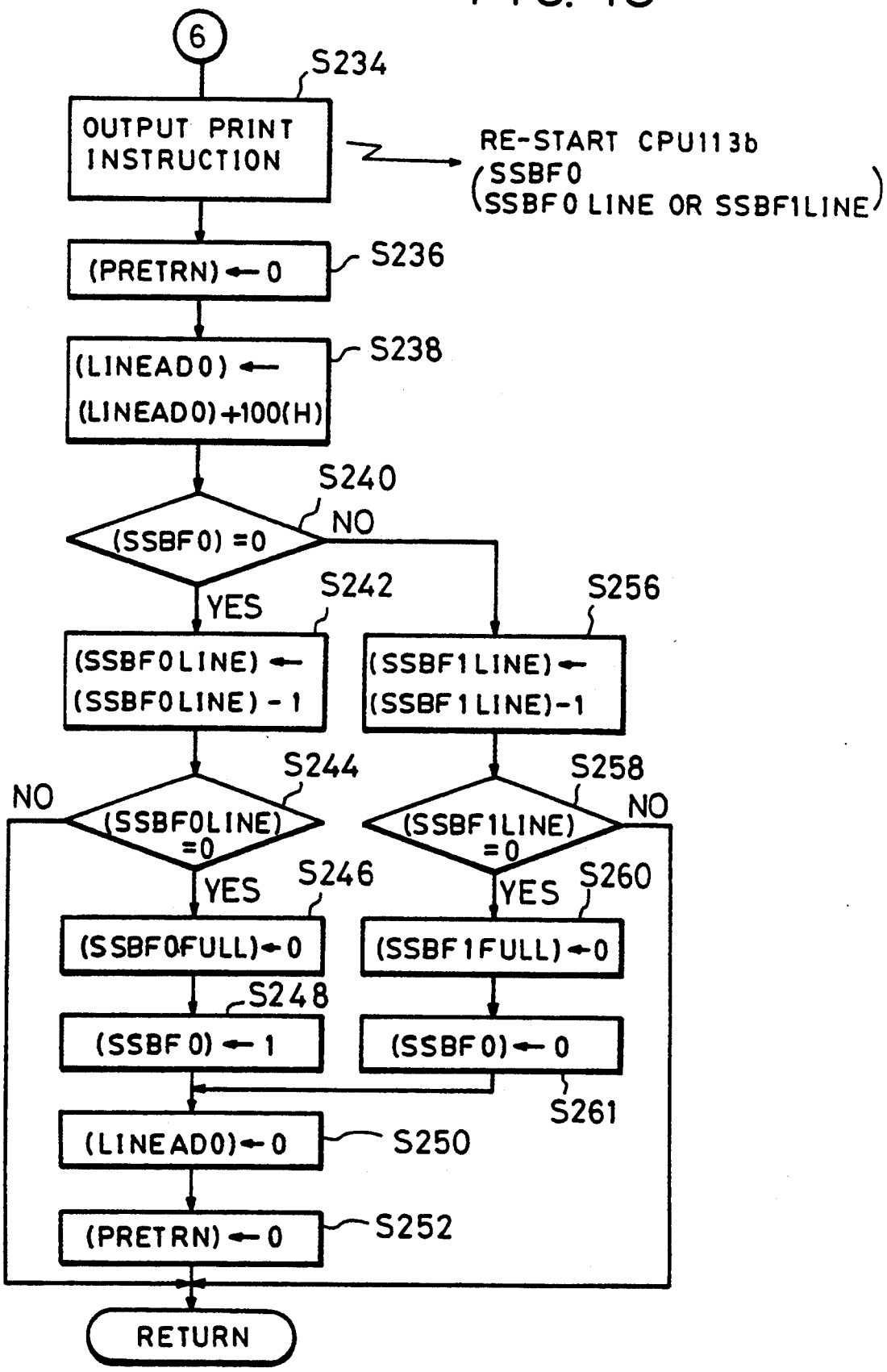
Figure 14:
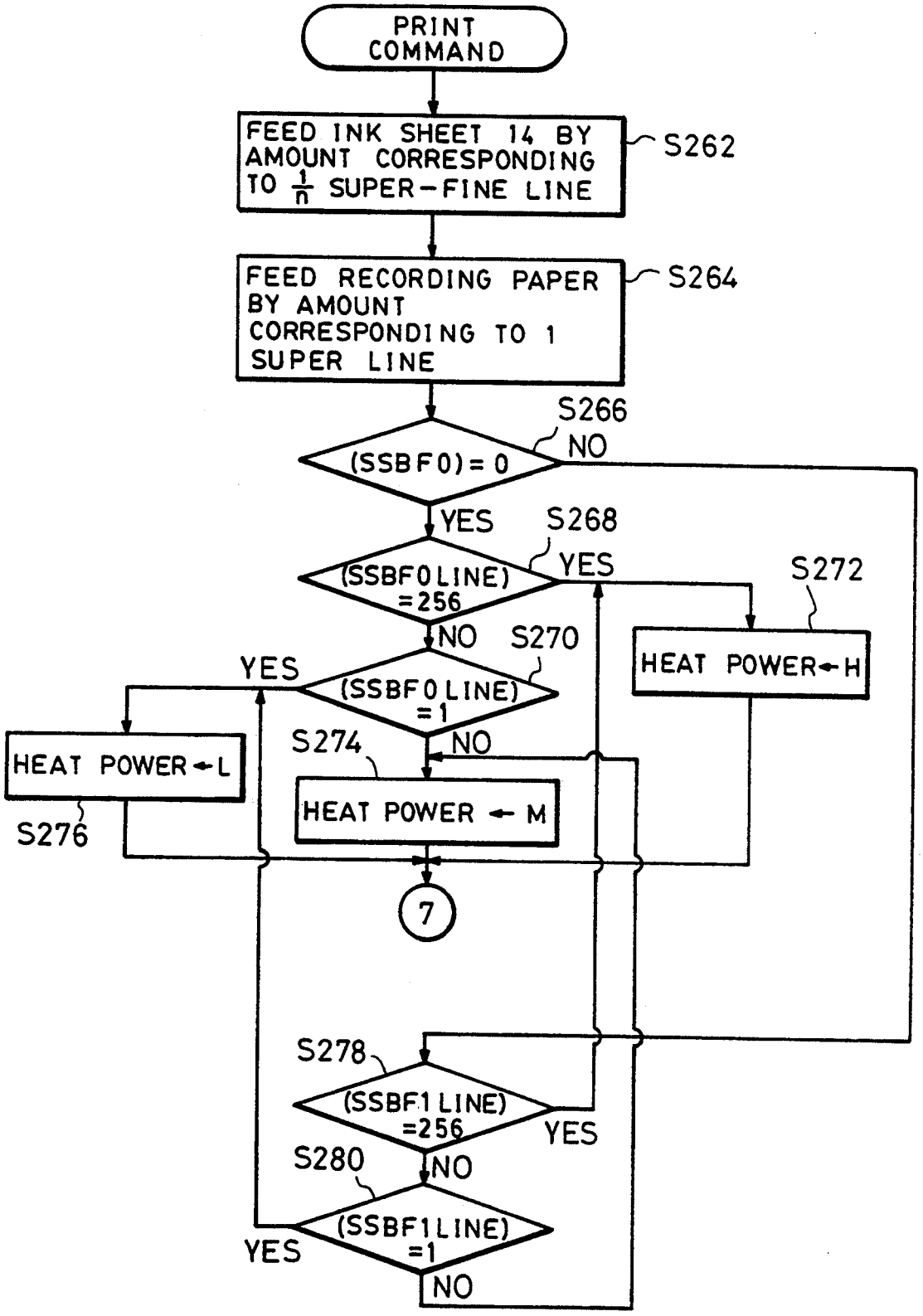
Figure 15:
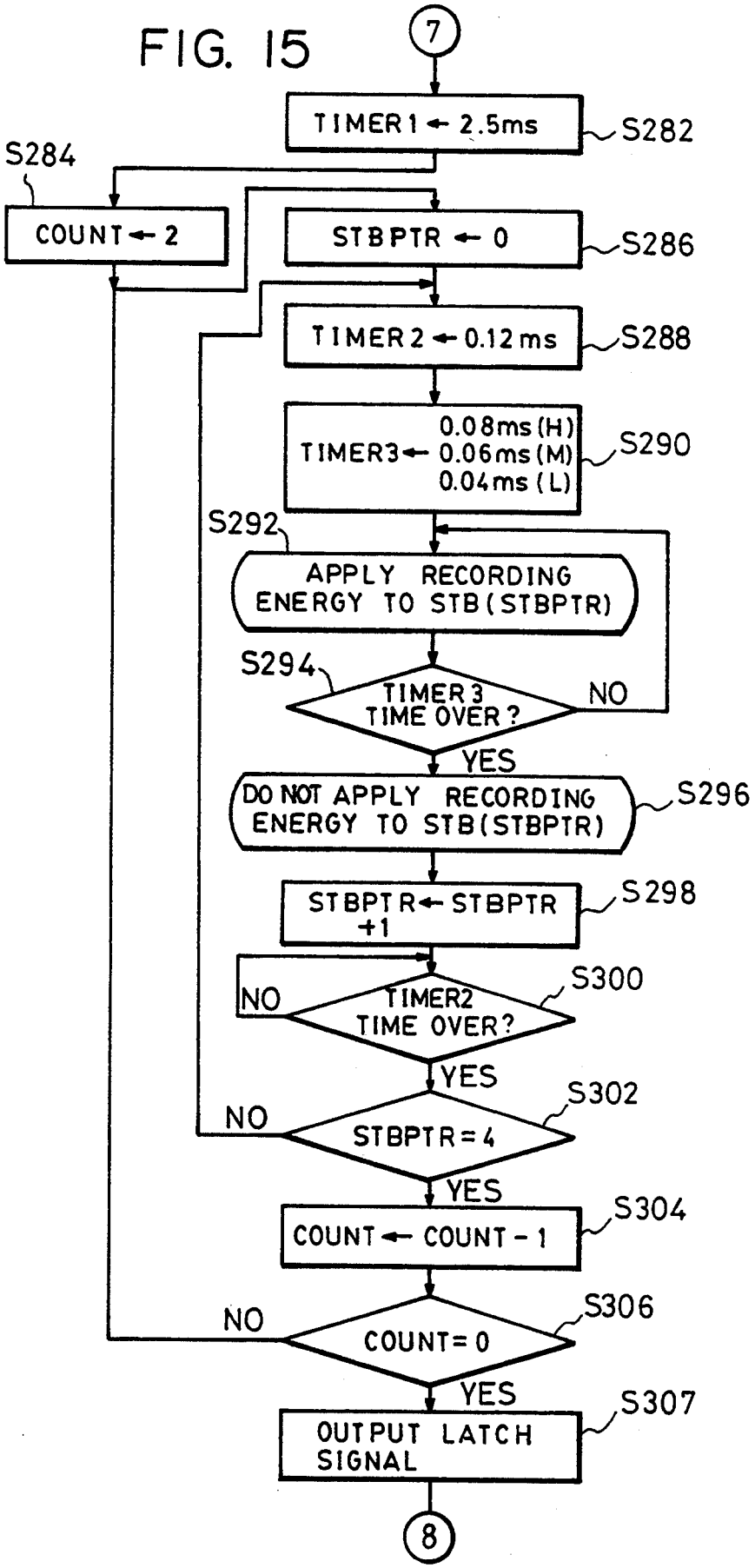
Figure 16:
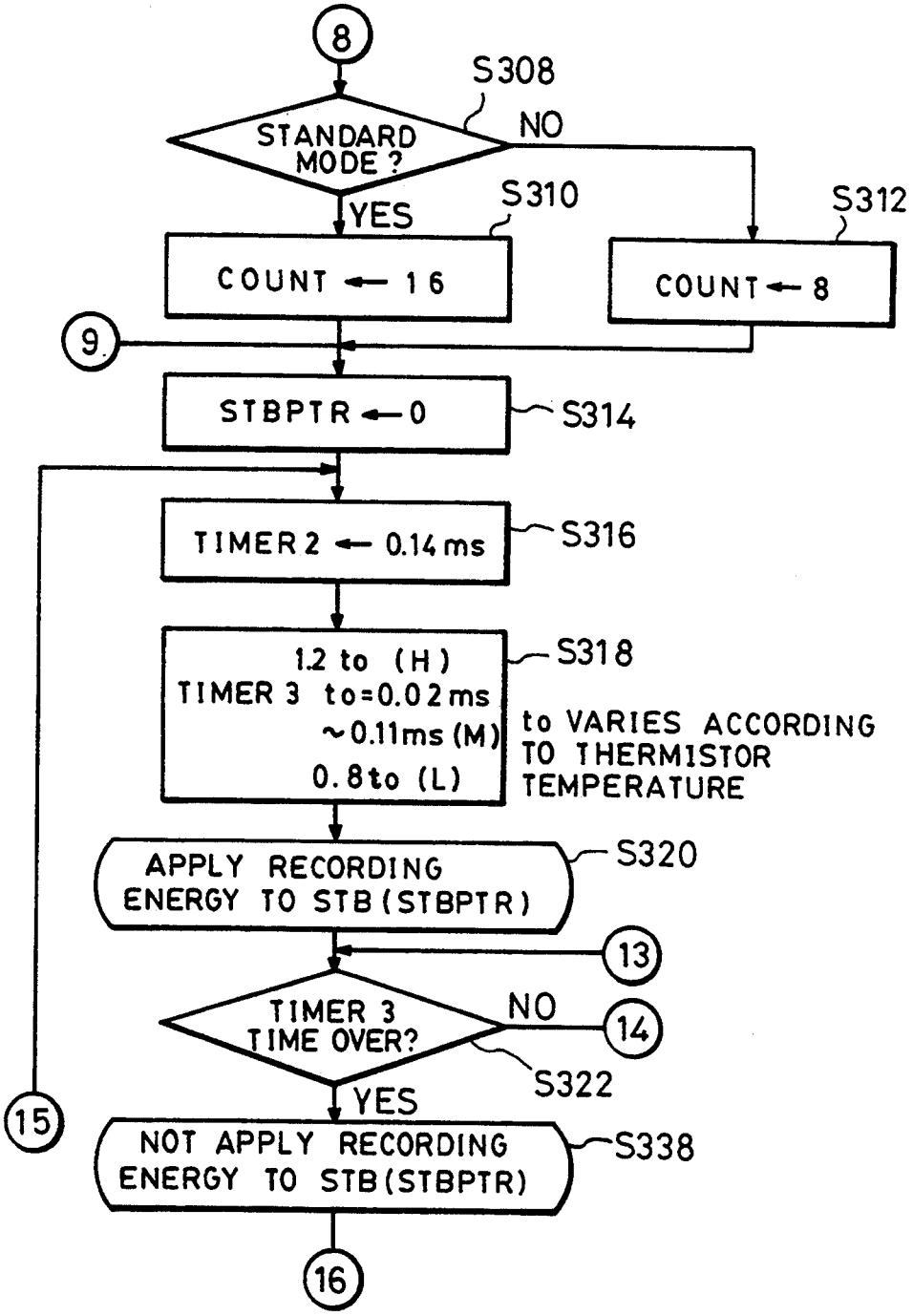
Figure 17:
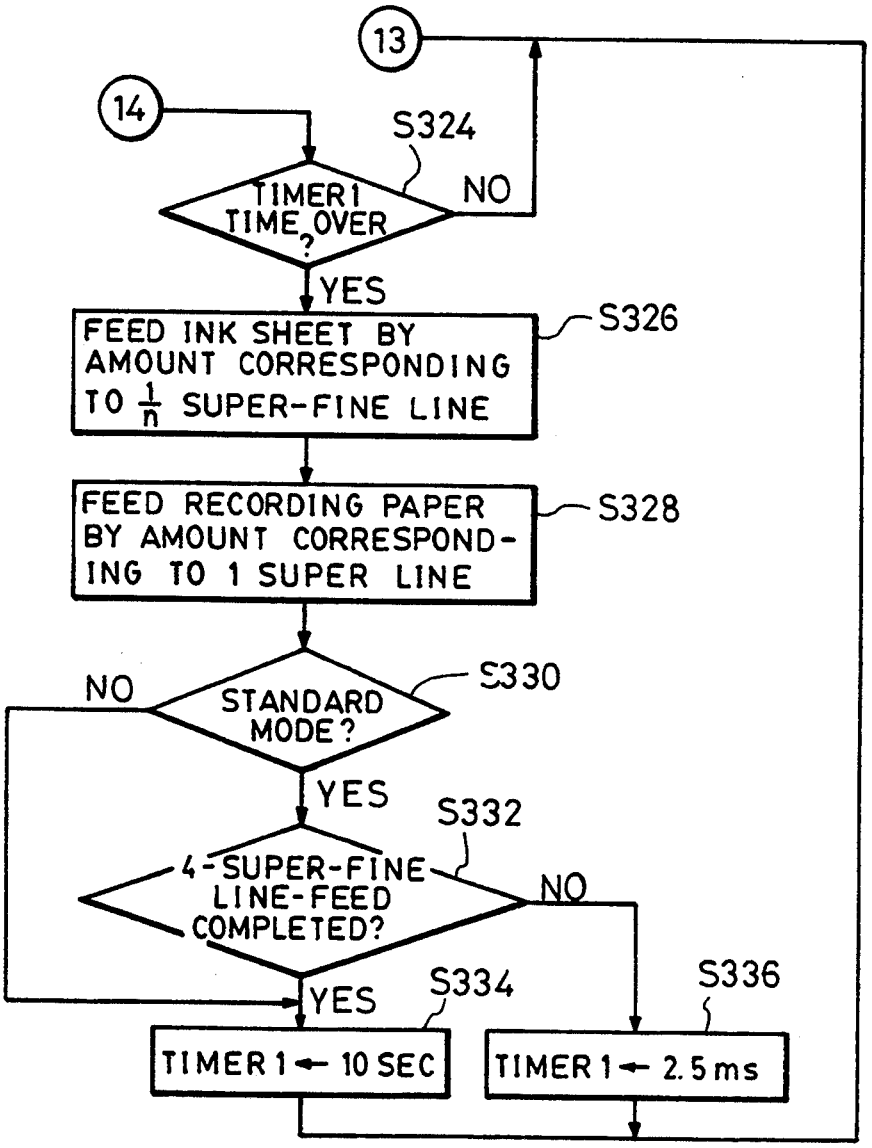
Figure 18:
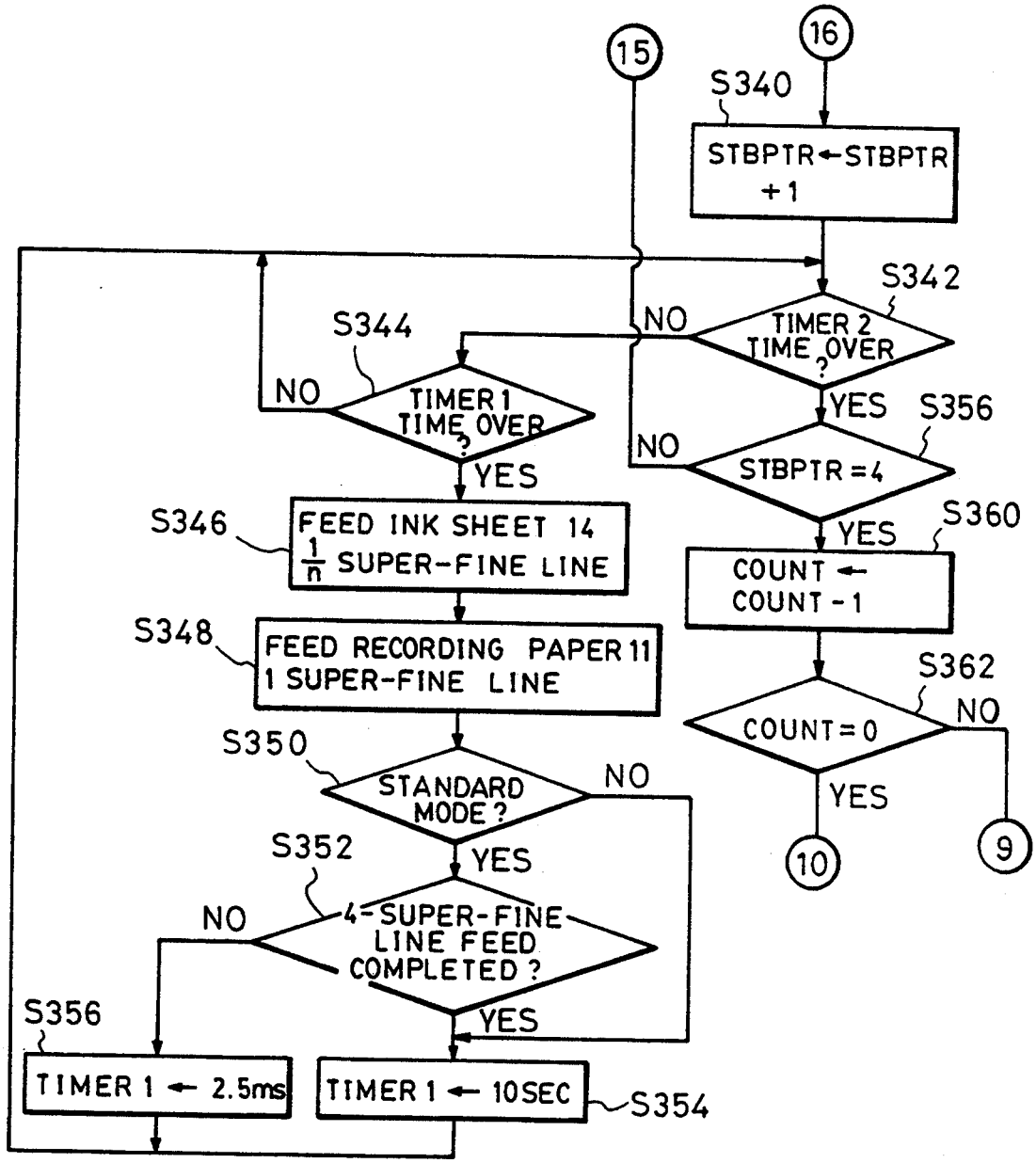
Figure 19:
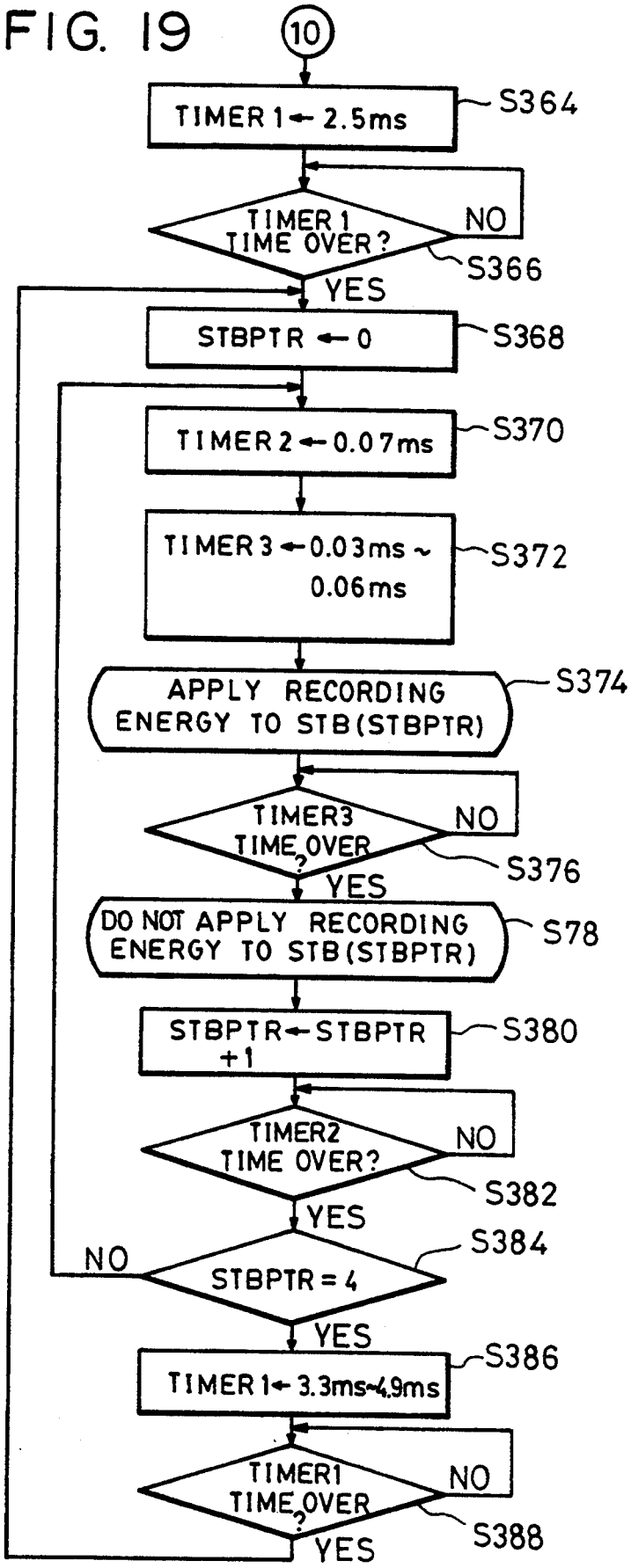

FIG. 5 also shows the flow of the process performed by the receiving system which forms a major portion of this embodiment. FIGS. 6 to 10 show a sub-routine called by respective steps in the flow pattern shown in FIG. 5. FIGS. 11 to 13 show an interrupt routine which is called by the interruptions which occur every 10 ms in accordance with the programmable timer 116. This routine performs constant-speed recording of the green data stored in the constant-speed buffer 0 or the constant-speed buffer 1. FIGS. 14 to 19 show a routine which is called by a step in the routine shown in FIG. 13. This routine is executed in parallel with the process performed by the CPU 113*b* in parallel with the operation of the CPU 113*a*. When the next printing instruction is received during execution of this routine, the operation which is being performed is suspended and the process returns to the first step of this routine.

Figure 6:
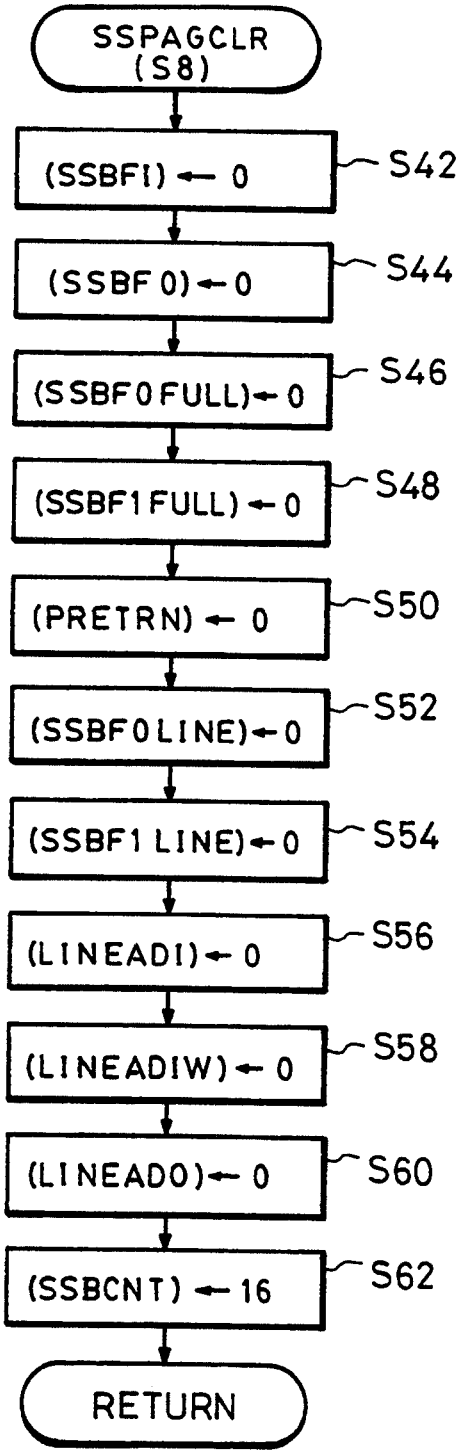

The main routine will be described with reference to FIG. 5. Referring to FIG. 5, whether the receiving operation has been selected is determined in step S2. When the receiving operation has not been selected, the process moves on to step S4 to conduct other processing. Conversely, if the receiving operation has been selected, the process continues to step S6 which performs a pre-procedure to determine the minimum transmission time which is required for completing one-line recording at a constant recording speed. In this embodiment, the minimum transmission time is 20 ms. The process continues to step S8 in which a page clearing operation for constant-speed recording is performed. The details of this page clearing operation will be described later with reference to FIG. 6, showing a routine SSPAGCLR. Then, the timer 116 is started in step S9.

Figure 7:
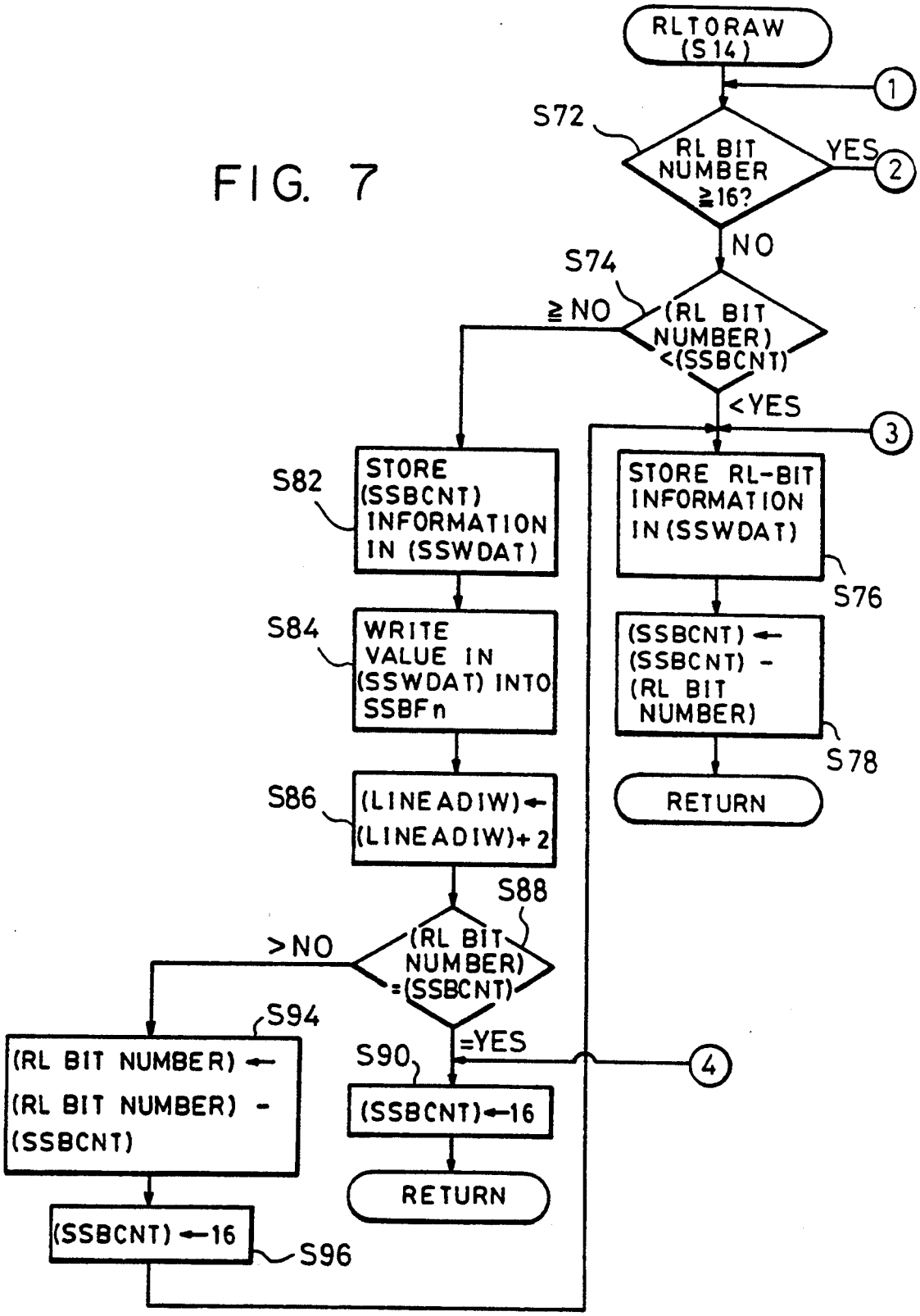
Figure 8:
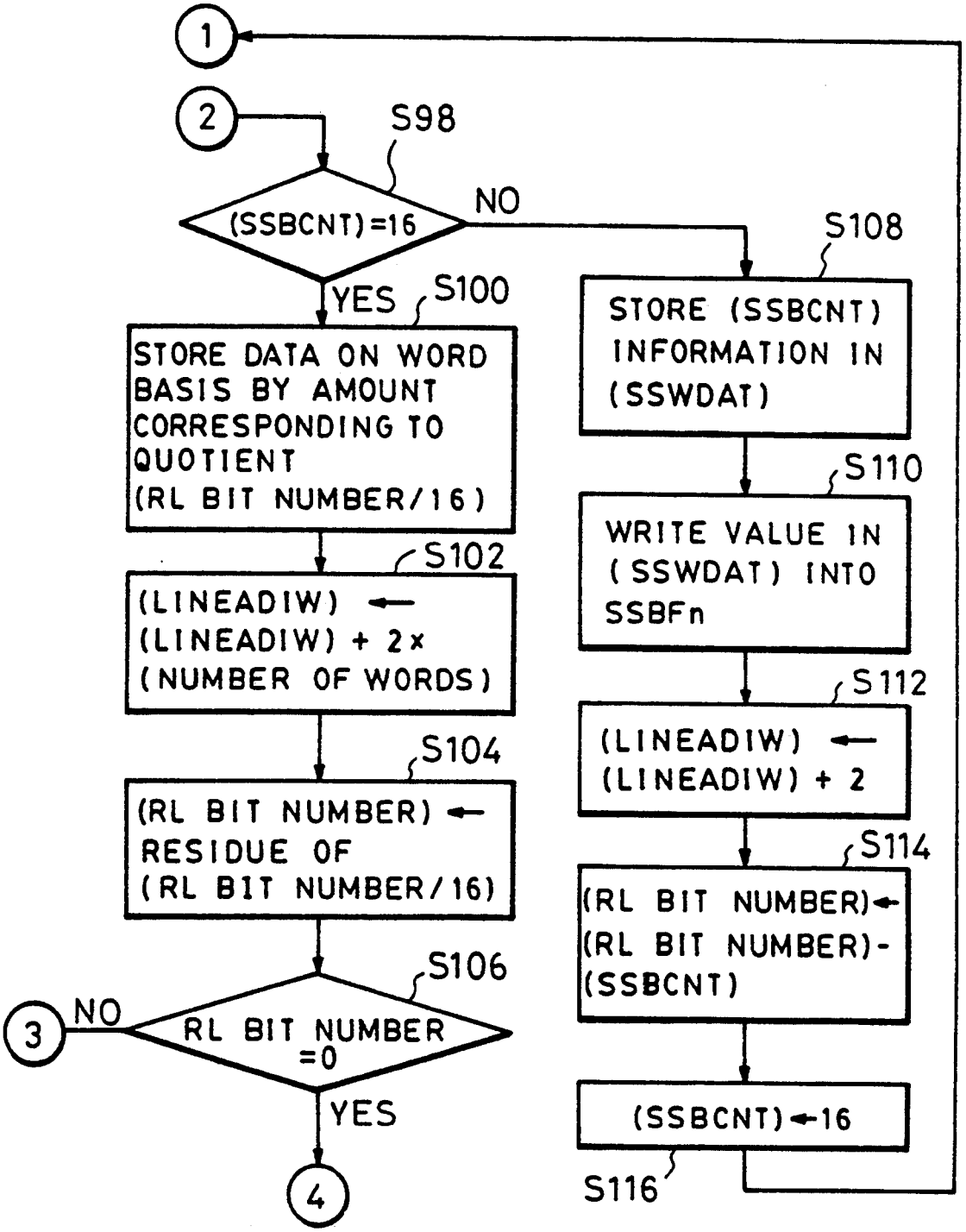

In step S10, decoded data are stored in a buffer memory 112 on an 8-bit basis. This is usually effected by an interruption of MODEM. In step S12, a decoding section 117 decodes coded data so as to form RL data. In step S14, one RL data is stored in the constant-speed buffer 0 or the constant-speed buffer 1, as will be detailed later with reference to FIGS. 7 and 8 showing a routine (RLTORAW). step S16 determines whether decoding of one-line data has been completed. If the decoding has been completed, the process proceeds to step S18 which executes a control peculiar to the end of line, as will be described later in connection with a routine LINECTL shown in FIG. 9.

Step S20 determines whether an RTC (return to control) signal indicative of the end of a page of the original to be transmitted. If the RTC signal has not been detected, the process returns to step S10 to repeat steps S10 through S20. Conversely, if the RTC signal is detected, the process advances to Step S22 in which, as will be described in detail with reference to FIG. 10 showing a routine RTCDET, a routine is conducted which is peculiar to the detection of the RTC signal, i.e., a routine which is conducted for completing the recording of all data in the constant-speed buffer 0 and the constant-speed buffer 1. Subsequently, the timer is stopped in step S23.

Steps S24 and S26 determine whether there is a next page and where there is a mode change. If there is no next page, the process progresses to step S30 which executes a post-procedure and is finished in step S32. When there is a next page but no mode change, the process returns to step S8 to commence processing of the next page. When both the next page and the mode change exist, the process goes on to step S28 to execute an intermediate procedure and the process then returns to step S8 to conduct processing of the next page.

The main sub-routines will be described next with reference to FIGS. 6 to 10.

A description will be given first of the page clearing sub-routine SSPAGCLR which is executed in step S8 of the flow shown in FIG. 5 for enabling constant-speed recording, with specific reference to FIG. 6.

In FIG. 6, flags and a counter which are to be cleared are shown. More specifically, SSBFI, SSBFO, SSBF0FULL, SSBF1FULL, PRETRN, SSBF0LINE, SSB1LINE, LINEADI, LINEADIW and LINEADO are each set to "0", while SSBCNT is set to "16".

The roles and functions of the flags and the counter and conditions for operating these flags and the counter will be described. In the following description, the term "interruption" means the interrupt routine which is called for every 10 ms. The term [byte] appearing at the end of the same of the flags and counter means an 8-bit data, while [word] means 16-bit data.

(Main System)

<SSBFI (Same speed buffer input)>[byte]

0: Information which is to be decoded is scheduled to be stored in SSBF0 or, alternatively, information which is being decoded is being stored in SSBF0.

1: Information which is to be decoded is scheduled to be stored in SSBF1 or, alternatively, information which is being decoded is being stored in SSBF1.

<LINEADI (Line address input)>[word]

This is a pointer used when green data is stored in SSBF0 or SSBF1.

<SSWDAT (Same speed word data)>[word]

This is a buffer used when decoded data is formed into word.

<SSBCNT (Same speed bit count)>[byte]

This stores the number of vacant bits in SSWDAT.

<LINEADIW (line address input word)>[word]

This indicates the address in SSBF0 or SSBF1 where green data is stored, and is used when the green data is to be stored.

<RLDAT (Run length data)>[word]

This is a register for storing information which, before the storage is conducted, has been delivered to the thermal head.

(Main interrupt system)

<SSBF0FULL (Same speed buffer 0 full)>[byte]

0: Storage of green data in SSBF0 has not been completed or, alternatively, all information in SSBF0 has been delivered to the thermal printhead (TPH).

1: Storage of green data in SSBF0 has been completed or, alternatively, information to be sent to TPH still remains in SSBF0. <SSBF1FULL (Same speed buffer 1 full)>[byte]

0: Storage of green data in SSBF1 has not been completed or, alternatively, all information in SSBF1 has been delivered to TPH.

1: Storage of green data in SSBF1 has been completed or, alternatively, information to be sent to TPH still remains in SSBF1.

<SSBF0LINE (Same speed buffer 0 line)>[word]

This represents the number of lines stored in SSBFO. In the main routine, the content of this buffer is incremented by 1 in response to storage of one-line green data, whereas, in the interruption, the content of this buffer is decremented by 1 in response to a transfer of one-line green data to TPH from SSBF0.

<SSBF0LINE (Same speed buffer 1 line)>[word]

This represents the number of lines stored in SSBF1. In the main routine, the content of this buffer is incremented by 1 in response to storage of one-line green data, whereas, in the interruption, the content of this buffer is decremented by 1 in response to transfer of one-line green data to TPH from SSBF1.

(Interrupt system)

<SSBFO (Same speed buffer output)>[byte]

0: The information which is going to be transferred to TPH is the data stored in SSBF0 or, alternatively, the information which is being transferred to TPH is the data stored in SSBF0.

1: The information which is going to be transferred to TPH is the data stored in SSBF1 or, alternatively, the information which is being transferred to TPH is the data stored in SSBF1.

<LINEADO (Line address output)>[word]

This is a pointer which is used when the line information stored in SSBF0 or SSB1 is output to TPH.

<PRETRN (Pre-heat data transfer)>[byte]

0: Pre-heat data is to be transferred to TPH at the next interruption.

1: Image information is to be transferred to TPH at the next interruption.

A description will now be given as to how the above-described flags and registers, as well as of the timings of various controls are all cleared.

<SSBFI>

Clear (concept of page)

This flag is initially "0". In this state, the green data is stored in SSBF0. This flag is then set alternately to "1" and "0" each time data is stored in one frame of the green data buffer (SSBF0 or SSBF1).

<SSBF0>

Clear (concept of page)

This flag is initially "0". In this state, the green data is output from SSBF0. This flag is then alternately set to "1" and "0" each time data is stored in one frame of the green data buffer (SSBF0 or SSBF1).

<SSBF0FULL>

Clear (concept of page)

This is initially set to "0". In this state, SSBF0 is empty. When data is stored in one frame of the green data buffer SSBF0, this flag is set to "1" and is set to "0" when all the data stored in the green data buffer SSBF0 have been transferred to TPH.

<SSBF1FULL>

Clear (concept of page)

This is initially set to "0". In this state, SSBF1 is empty. When data is stored in one frame of the green data buffer SSBF1, this flag is set to "1" and is set to "0" when all the data stored in the green data buffer SSBF1 have been transferred to TPH.

<PRETRN>

Clear (concept of buffer)

This is initially "0". In this state, there is no image information and pre-heating is conducted. When the interruption has occurred, pre-heat data is transferred on the condition that PRETRN is "0" and image information is transferred on the condition that PRETRN is "1".

<SSBF0LINE>

Clear (concept of page)

This is initially "0". In this state, SSBF0 is empty. The content is incremented by 1 each time one-line green data is stored in SSBF0 and decremented by 1 each time one-line data is transferred from SSBF0 to TPH.

<SSBF1LINE>

Clear (concept of page)

This is initially "0". In this state, SSBF1 is empty. The content is incremented by 1 each time one-line green data is stored in SSBF1 and decremented by 1 each time one-line data is transferred from SSBF1 to TPH.

<LINEADI>

Clear (concept of buffer)

The start address for the storage of green data is initially set to "0". +100 H is executed each time one-line green data is stored in the green data buffer (SSBF0 or SSBF1)

<LINEADIW>

Clear (concept of line)

The address in line is initially "0". A new LINEADI is stored each time one-line data is stored in the green data buffer (SSBF0 or SSBF1) and, each time decoded data of a predetermined number of words are stored in the green data buffer (SSBF0 or SSBF1), a value which is double the number of the stored words is added.

<LINEADO>

Clear (concept of buffer)

The reading of the data from the green data buffer is started from address "0". +100 H is effected each time one-line green data is output from the green data buffer (SSBF0 or SSBF1) to TPH.

<SSBF0 or SSBF1) to TPH.

<SSBCNT>

Clear (concept of line)

The position address in SSWDAT is initially "0". When n-bit data (n<16) is formed, the n-bit data is stored in SSWDAT from the left end and SSBCNT is set to (SSBCNT−n). When one word data is formed, SSWDAT is stored in the green data buffer CSSBF0 or SSBF1 to set SSBCNT to 16.

<RLDAT>

This is not cleared. This stores the information which, before the storage, was output to the thermal head to enable this information in the production of RAW data.

A description will now be given of the sub-routine RLTORAW which is conducted in Step S14 of the flow of FIG. 5 and which stores one RL as green data into the constant speed buffer 0 or the constant speed buffer 1, with specific reference to FIGS. 7 and 8.

In this embodiment, each of the constant speed buffer 0 and the constant speed buffer 1 has a memory space of 64 Kbytes. The segment value of the constant speed buffer 0 is, for example, 4000 H, whereas, the segment value of the constant speed buffer 1 is, for example, 5000 H. The offset value of the address is controlled by LINEADI, LINEADIW and LINEADO.

The routine RLTORAW is called after determining the white/black information obtained by decoding of the demodulated data and determining the bit number of RL of the black/white information. Then, the information (white or black) corresponding to the RL bits is stored in the constant speed buffer memory. The nature of the white/black information and the manner of storage in the constant speed buffer 0 or the constant speed buffer 1 are now described in connection with FIGS. 7 and 8.

Step S72 determines whether the bit number of RL is less than 16. If the bit number is greater than or equal to 16, the process proceeds to Step S98, whereas, when the bit number is less than 16, the process proceeds to step S74.

In step S74, i.e., when the bit number is less than 16, it is determined whether the RL bit number is below the content of SSBCNT. If the RL bit number is below the content of SSBCNT, the process continues to step S76 which stores the information corresponding to the RL bits in SSWDAT. The process then returns after subtracting the RL bit number from the content of SSBCNT in Step S78.

Conversely, when the RL bit number is determined to be greater than or equal to the content of SSBCNT in step S74, the process proceeds to Step S82 which stores information corresponding to the contents of SSBCNT in the word data SSWDAT and further proceeds to step S84 which stores the data of SSWDAT in the corresponding constant speed buffer (0 or 1). Then, in step S86, the offset address LINEADIW for the storage in the constant speed buffer is incremented by 2.

Step S88 determines whether the RL bit number is equal to the number of bits in SSBCNT. The fact that the RL bit number is equal to the number of bits in SSBCNT means that the transfer on the word basis has just been completed. In this case, the process returns after setting "16" in SSBCNT in step S90. However, if the RL bit number is not equal to the number of bits in SSBCNT, the process advances to step S94 in which the number of bits in SSBCNT is subtracted from the RL bit number and the RL bit number is set to the value of the result of the subtraction. The process then moves on to step S96 in which "16" is set in SSBCNT. Then, the process skips to step S76 in which processing is conducted for the transfer of the odd portion of the final word.

Conversely, when the RL bit number is 16 or greater, whether the content of SSBCNT is "16" or not is determined in step S98. If the content of SSBCNT is "15", the process progresses to step S100 in which data is stored in corresponding constant speed buffer by an amount corresponding to the quotient (RL bit number/16). The process then goes to step S102 in which (2×number of transferred words) is added to the offset address LINEADIW. Then, in step S104, the RL bit number is set to the residue of (RL bit number/16).

Step S106 determines whether the RL bit number is "0". The fact that the RL bit number is "0" means that the transfer is being done just on the word basis. In this case, therefore, the process continues to step S90. Conversely, when the RL bit number is not "0", the process moves to step S76 for the processing for the transfer of odd portion of the final word.

When step S98 has determined that the content of SSBCNT is not "16", it is judged that the initial word is odd, so that the process proceeds to step S108 in which information is stored T in an amount corresponding to the content of SSBCNT. In step S110, word data of SSWDAT is stored in the corresponding constant speed buffer. Then, in step S112, the offset address LINEADIW is incremented by 2. In step S114, the content of SSBCNT is subtracted from the RL bit number and, in step S116, "16" is set in SSBCNT. Then, the process returns to step S72 to execute the following processing of RL bits.

A description will now be given with specific reference to FIG. 9 of the sub-routine LINECTL which is executed in Step S18 of the flow shown in FIG. 5 and which is called after conversion of the one-line information into green data.

Step S122 determines whether the constant speed buffer which presently stores the data is the constant speed buffer 0 or the constant speed buffer 1. It is assumed that the buffer storing the data is the constant speed buffer 0. In this case, one-line data has been stored in the constant-speed buffer 0, so that SSBF0LINE is incremented by 1 in step S124. When the storage of the green data in the constant speed buffer 0 is completed, step S126 determines that the content of SSBF0LINE is "256". This means that the constant speed buffer 0 has become full. In such a case, "1" is set in SSBFOFULL in step S128. Then, "1" is set in SSBF1 to designate the constant speed buffer 1 as the buffer in which the next data is to be stored. In steps S132 and S134, offset addresses LINEADI and LINEADIW for storage in the constant speed buffer are cleared. The process then returns.

When the storage of the green data in the constant speed buffer 0 has not been completed, step S126 determines that the content of SSBF0LINE is not "256". In this case, the proces proceeds to step S138 in which "16" is set in SSBCNT to enable storage of the next line in the constant speed buffer. Then, in step S140, 100 H is added to LINEADI, since the size of one-line data is 100 H bytes and, in step S142, the value of LINEADI is stored in LINEADIW. The process then returns.

If step S122 has determined that the constant speed buffer in which the data is being stored is the constant speed buffer 1, a control similar to that performed in steps S124 through S130 is executed in steps S146 through S152.

FIG. 10 shows the processing routine RTCDET which is executed when the RTC signal is detected. In this routine, FULL is set to the constant speed buffer which is storing the green data, on condition of completion of recording of at least one line and waits for completion of recording of all data stored in the constant speed buffer.

Step S162 determines whether the constant speed buffer presently storing the data is the constant speed buffer 0 or the constant speed buffer 1. If the buffer is the constant speed buffer 0, the process advances to step S164 which determines the number of the line stored in the constant speed buffer 0 is "0". If it is "0", the process proceeds to step S176 and waits for the completion of the data output from the constant speed buffer 1. If it is not "0", the process proceeds to Step S166 in which"1" is set in SSBF0FULL. The process then proceeds to step S168 to wait until the recording of the green data is completed, i.e., until SSBF0FULL becomes "0". The process then returns.

If step S162 has determined that the buffer in which the data is being stored is the constant speed buffer 1, a control similar to that performed in steps S164 through S168 is executed in steps S172 through S176.

Next, the main interrupt routine will be described with reference to FIGS. 11 to 13.

FIGS. 11 to 13 illustrate the interrupt routine SAMESPDCTL which is called by the timer 116 every 10 ms and which executes the constant speed recording.

Step S182 determines whether the constant speed buffer which is presently storing the data or which is going to store the data is the consatnt speed buffer 0 or the consatnt speed buffer 1. If the buffer is the constant speed buffer 0, the process progresses to step S184 which determines whether the storage of the green data in the constant speed buffer 0 has been completed, i.e., whether SSBF0FULL has been set to "1". If SSBF0FULL is "0", the process returns without exercising any control, whereas, if SSBF0FULL is "1", the process proceeds to step S188 to check PRETRN. If PRETRN is "0", the process proceeds to step S188 in which a smoothing circuit is turned off and, in Step S190, all-black pre-heat data is transferred to the CPU 113*b*. The process then moves to step S192 in which "1" is set in PRETRN. The operation in step S188 is performed because data smoothing is not necessary when the data to be transferred is the pre-heat data.

If the determination in step S186 has proved that PRETRN is "1", steps S202 onwards are followed to perform recording of one line data. If the determination in step S182 has proved that SSBF0 is "1", the process proceeds to step S196. Steps S196 to S200 perform a control similar to that performed in Steps S184 and S186.

The recording of one line data is conducted as follows. In step S202, the offset address LINEADO output from the constant speed buffer for the purpose of recording is stored in the register S1.

In steps S204, S206 and S206, the number of the word transferred corresponding to the head size is set in CX. More specifically, 216/2 is set in CX when the head size is A4 and 256/2 is set in CX when the head size is B4. In this case, since the data is effective image data, the smoothing circuit is turned on in step S210. Then, in step S212, a latch signal is delivered to latch the pre-heat data.

Steps S214 to S232 transfers to the thermal head the data of the designated line (determined by LINEADO)

in the constant speed buffer which is now participating in the recording (determined by SSBFO). Steps S224 to S230 are repeatedly executed until the transfer of one-line data to the thermal head is completed. More specifically, in steps S214 to S222, either the constant speed buffer 0 or the constant speed buffer 1 is appointed in accordance with the value in SSBF0 and, in steps S224 and S226, the data of the line appointed by LINEADO0 is transferred to the thermal head 13. After passage of a predetermined time measured in step s228, SI is set to (SI+2) and the process returns to step S224 to repeat the above-described routine. In step S234, the CPU 113*a* delivers to the CPU 113*b* a printing instruction together with the required information (SSBF0 and SSBF0LINE or SSBF1LINE). Thereafter, CPU 113*b* executes printing of one line data in parallel with the operation of CPU 113*a*.

In step S236, PRETRN is cleared and, in step S238, 100H is added to LINEADO. Step S240 determines whether the constant speed buffer which is now participating in the recording is the constant speed buffer 0 or the constant speed buffer 1.

When the buffer is the constant speed buffer 0, SSBF0LINE is decremented by 1 in step S242, since this means that recording of one line data has been completed. When the value in SSBF0LINE has become "0", i.e., when the recording is finished with all the data which has been stored in the constant speed buffer 0, the process shifts to step S246 which clears SSBF0FULL and then to step S248 which sets "1" in SSBF0 to declare that the next recording is to be conducted with the data from the constant speed buffer 1. The process then returns after clearing LINEADO and PRETRN in step S252.

If it has been determined in step S240 that the buffer participating in the recording is the constant speed buffer 1, the process proceeds to step S256. Steps S256 to S261 perform a control similar to that executed in steps S242 to S248.

The sub-interrupt routine will be described with reference to FIGS. 14 to 19.

Figure 20:
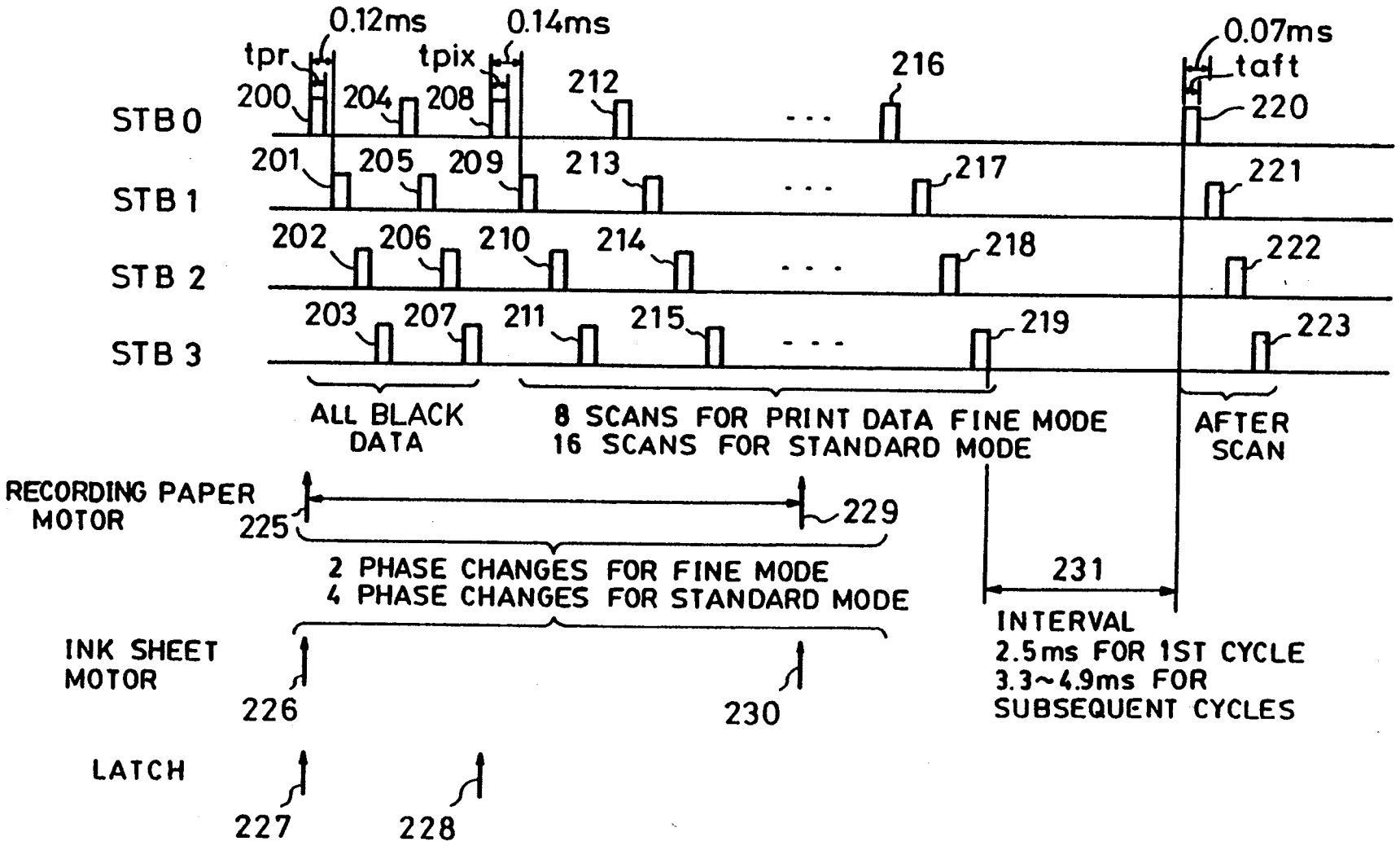
FIG. 20 is a timing chart showing the timing for thermal head energization, timing ink sheet feeding and the timing of recording paper feeding.

FIGS. 14 to 19 show the process performed by the CPU 113*b* in response to the printing instruction. FIG. 20 shows the timings of operations performed in the image recording apparatus of the invention, including energizing the thermal head 13, feeding the ink sheet and feeding the recording paper. FIG. 21 shows an example of the control of pulse width according to the position of the print line. In the illustrated embodiment, the heat-generating elements 132 of the thermal head 13 are divided into four groups and are energized on the basis of such blocks. The strobe signals STB1 to STB4 respectively correspond to the signals delivered to these four blocks of the heat-generating elements of the thermal head 13.

Referring first to FIG. 20, the pre-heat data is latched in the main interrupt routine (time 227). Then, phase changes are effected on the recording paper feed motor 24 (time 225) and on the ink sheet feed motor 25 (time 226) so as to feed the recording paper and the ink sheet, respectively. These operations correspond to those performed in steps S264 and S262 in the flow shown in FIG. 14. Steps S266 to S280 in the flow shown in FIG. 14 select either the constant speed buffer 0 or the constant speed buffer 1 and control the heat power such that the heat power is set to "H" when the line which is being recorded is the initial line of a block composed of 256-line data which can be stored in the constant speed buffer and to "L" when the line which is being printed is the last line of the above-mentioned block. When the line being printed is neither the initial line nor the last line, the heat power is set to "M".

Referring to FIG. 20. the recording paper feed motor 24 and the ink sheet feed motor 25 are adapted to feed, respectively, the recording paper and the ink sheet by an amount corresponding to one line and an amount corresponding to 1/n of one line when printing in the super-fine mode, in response to a single phase-change operation. The next phase change is effected after the passage of 2.5 ms, i.e., at times 229 and 230. Phase change is effected twice in fine mode and four times in standard mode. These operations are executed in steps S282, steps S324 to S336 and steps S334 to S356 in the flow shown in FIGS. 15 to 19. The time duration of 10 seconds set in steps S334 and S354 has no specific meaning and any substantial time may be set.

In FIG. 20, numerals 200 to 207 represent the recording of all-black pre-heat data. The width of each strobe pulse is 0.12 ms. The space for the width tpr of the pulse for applying the recording energy is 0.08 ms for the initial line of the data block consisting of 256 lines and 0.04 ms for the last line of the block, whereas pulses 0.06 ms long are used for intermediate lines. These controls are implemented in steps S282 to S306 in the flow shown in FIG. 15. It will be seen that the time set in the timer 3 is varied depending on the level of the heat power, i.e., H, M or L. The widths tpr, taft and tpix of the recording energy pulses for different line positions are shown in the table set forth in FIG. 21.

Referring again to FIG. 20, a latch signal is issued at a time 228 to latch the image information. This control is performed in step S307 in the flow shown in FIG. 15.

In FIG. 20, numerals 208 to 219 show the recording of image information. The duration of each strobe pulse is 0.14 ms. The width tpix of the pulse for applying the recording energy is 1.2×(0.02 ms to 0.11 ms) for the initial line of the block, 0.8×(0.02 ms to 0.11 ms) for the last line of the block and 0.02 ms to 0.11 ms for other lines. The pulse duration is controlled between 0.02 ms and 0.11 ms in accordance with the temperature of the thermal head as measured by a thermistor. In general, the pulse width is increased as the head temperature becomes lower. Printing of the image information is conducted by 8 scans in fine mode and 16 scans in standard mode. These controls are executed in steps S308 to S362 of FIGS. 16 to 18, excepting steps S324 to S336 and S344 to S356.

Referring again to FIG. 20, an after-scan is conducted after completion of the image information. The after-scan is conducted at a time interval of 2.5 ms when the after-scan is conducted for the first time, and, for the second and following after-scans, the interval is controlled in accordance with the thermal head temperature measured by the thermistor, within the range between 3.3 ms and 4.9 ms. The duration of the pulse of each strobe in the after-scan is 0.07 ms. The pulse duration taft of the pulses for applying the recording energy is constant over the entire line information in the block and is determined to range between 0.03 ms and 0.063 ms in accordance with the thermal head temperature measured by the thermistor. These controls are conducted in steps S364 to S388 in the flow shown in FIG. 19.

A more detailed description will be given of the process shown in FIGS. 14 to 20. In response to a printing instruction, step S262 activates the ink sheet feed motor 24 so as to feed the ink sheet 14 by an amount which is (1/n) of one line in terms of super-fine mode. Then, in step S264 activates the recording paper feed motor 25 so as to feed the recording paper 11 by an amount corresponding to one line of the super-fine mode. In step S266, either the data in the constant speed buffer 0 or the data in the constant speed buffer 1 is selected as the data which is to be sent to the thermal printhead. Steps S268 to S280 determine whether the present line is the first line of the block, last line (256-th line) of the block or an intermediate line. When the present line is the first line, the heat power is set to "L" in step S276 and, when the present line is the last line of the block, the heat power is set to "H" in step S272. In the event of an intermediate line, the heat power is set to "M" in Step S274.

Subsequently, a pre-heat control is conducted in steps S282 to S307. In step S282, a timer TIMER 1 is set to 2.5 ms for the purpose of phase change of the ink sheet feed motor 24 and, in step S284, the counter COUNT is set to 2. Then, in step S286, a counter STBPTR is reset to count the number of strobes. Then, for the purpose of determining the maximum pulse duration of the strobe, 0.12 ms is set in a timer TIMER 2 in step S288 and, in step S290, a time corresponding to the number or position of the line is set in a timer TIMER 3, which determines the duration tpr of the pulse for applying pre-heating energy. More specifically, the timer TIMER 3 is set to 0.04 ms when the line is the first line and set to 0.08 ms when the line is the final line of the block. For other lines, the timer TIMER 3 is set to 0.06 ms. In steps S292 to S300, the strobe signal is held in on state for the time set in the timer TIMER 3 and then the content of STBPTR is incremented by 1. Steps S288 to S300 are repeatedly executed until the content of STBPTR reaching "4" is detected in step S302. Then, the content of the counter COUNT is decremented by 1. Steps S286 to S304 are repeatedly executed until the content of the counter COUNT becomes "0". When the content of the counter COUNT has been reduced to "0", a latch signal is issued in step S307 to latch the print data, thus commencing the printing operation.

More specifically, in Step S308, a determination is made as to whether the present mode is the standard mode or not. If the current mode is determined to be the standard mode, the process goes on to step S310 which sets "16" in the counter COUNT. However, if the current mode is not the standard mode, the process skips to step S312 in which "8" is set in the counter COUNT. In step S314, STBPTR is reset to "0" and, in step S316, 0.14 ms is set in the timer TIMER 2 as the duration of the strobe in the printing mode. In step S318, the timer TIMER 3 is set to a time which is determined by the line number and the thermal head temperature sensed by the thermistor. More specifically, when the line is the first line of the block, the timer TIMER 3 is set to 0.8×(0.02 ms to 0.11 ms) and, when the line is the last line of the block, 1.2×(0.02 ms to 0.11 ms) is set in the timer TIMER 3. For other lines, the timer TIMER 3 is set to a time between 0.02 ms and 0.11 ms. The time value in the above-mentioned range of between 0.02 ms and 0.11 ms is selected in accordance with the temperature of the thermal head determined by the thermistor. To this end, the output of the thermistor is picked up by the CPU in advance of the start of pre-heating of each line. Then, the strobe signal is maintained on until the time set in the timer TIMER 3 passes. Meanwhile, the state of the timer TIMER 1 is monitored in step S324 and, when the time set in this time is over, the ink sheet 14 is fed in step S326 by an amount corresponding to (1/n) of one line in terms of super-fine mode. Then, step S330 determines whether the present mode is the standard mode or not. When the present mode is determined to be the standard mode, the process shifts to step S332 which determines whether feeding by an amount corresponding to 4 lines in terms of super-fine mode has been completed. If this feed has not been completed yet, 2.5 ms is again set in the timer TIMER 1 in step S336, whereas, if the feed has been completed, 10 sec is set in the timer TIMER 1. The process then moves to step S322. If in step S330 it is determined that the present mode is not the standard mode, the process skips to step S334 in which 10 sec. is set in the timer TIMER 1 and then returns to step S322.

In the event that the time set in the timer TIMER 3 passes, the strobe signal is turned off in step S338 and, in step S340, the contents of STBPTR are incremented by 1. Subsequently, whether the time set in the timer TIMER 2 has elapsed is determined. Steps S344 to S356 are repeatedly executed to carry out the same processing as that performed in steps S324 to S336, until the time set in the timer TIMER 2 has passed. When the time set in the timer TIMER 2 passes, it is determined whether the contents of STBPTR are "4" and the process repeatedly returns to step S316 until the contents become "4". When the contents of STBPTR have become "4", "1" is subtracted from the contents of the counter COUNT. The process repeatedly returns to step S314 to perform the above-described operation until the contents of the counter COUNT becomes "0".

After-heat operation is commenced when the contents of the counter COUNT have become "0". In step S364, 2.5 ms is set in the timer TIMER 1 and the process halts at step S366 until the time set in this timer passes. Then, in step S368, STBPTR is reset to "0" and, in step S370, 0.07 ms is set in the timer TIMER 2 as the duration of the pulse of the after-scan probe. A suitable time ranging from 0.03 ms to 0.06 ms, determined in accordance with the thermal head temperature sensed by the thermistor, is set in the timer TIMER 3 as the after-heat time. In steps S376 and S378, the strobe signal is turned and maintained on until the time set in the timer TIMER 3 elapses. When the time set in this timer is over, the strobe signal is turned off in step S378 and "1" is added to the content of STBPTR in step S380. In step S382, the process waits until the time set in the timer TIMER 2 is over and, when this time is over, it is determined whether the contents of STBPTR are "4" in step S384. The process then repeatedly returns to Step S370 until the content of STBPTR becomes "4". When the content of STBPTR has reached "4", a time ranging from 3.3 ms to 4.9 ms is set in the timer TIMER 1 in step S386 and, after passage of the time set in timer TIMER 1, the process returns to step S368. Thereafter, the post-heating is conducted at this time interval until the next printing instruction is received. The length of the time set in the timer TIMER 1 is determined on the basis of the output from the thermistor 133 which senses the temperature of the thermal head prior to the start of each after-scan cycle. The length of time corresponding to the after-scan pulse width is increased as the measured thermal head temperature decreases.

The recording principle will be discussed with reference to FIG. 22.

Figure 22:
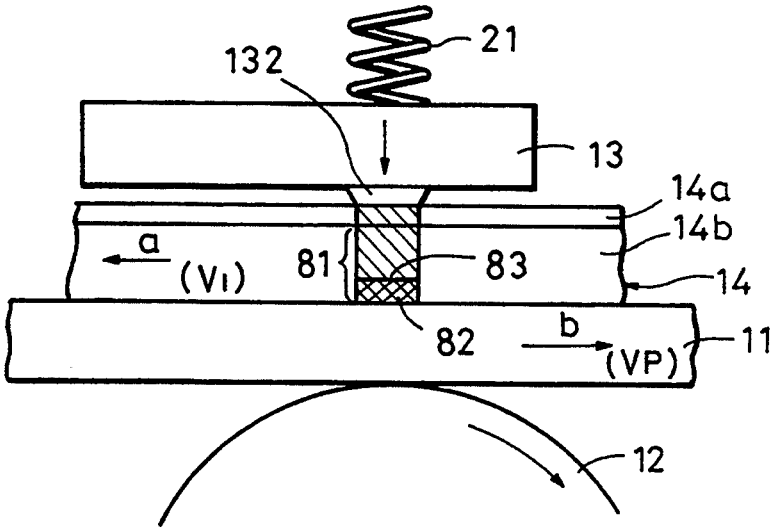
FIG. 22 is an illustration of the recording paper and the ink sheet during recording.

FIG. 22 illustrates the principles of image recording performed in the illustrated embodiment with the ink sheet 14 and recording paper 11 fed in opposite directions.

As will be seen from this Figure, the recording paper 11 and the ink sheet 14 superposed on one another are passed between the platen roller 12 and the thermal head 13. The thermal head 13 is urged with a predetermined force towards the platen roller 12 by means of the spring 21. The recording paper 11 is fed at a speed VP in the direction of the arrow b as a result of rotation of the platen roller 12, while the ink sheet 14 is fed in the direction of the arrow a at a speed VI by the torque produced by the ink sheet feed motor 25.

Assuming here that a particular heat-generating resistor element 132 on the thermal head 13 is energized by the power from the electrical power supply 105 so as to heat the hatched region 81 of the ink sheet 14. Numeral 14*a* denotes a base film of the ink sheet 14, while 14*b* denotes an ink layer on the base sheet 14*a*. A portion 81 of the ink layer is melted by the heat from the heat-generating resistor element 132 so that this region 81 of the ink layer melts. The portion denoted by 82 in this molten region is transferred to the recording paper 11. The thickness of this portion 82 is about (1/n) the total thickness of the ink layer 81.

In order to maintain good print quality, it is necessary to apply a shear force along the boundary 83 between the portion 82 of the ink layer to be transferred and the remaining portion of the ink layer, so as to ensure that only the portion 82 is transferred to the recording paper 11. The shearing force can be increased by increasing the relative speed between the ink sheet 14 and the recording paper 11. By applying a sufficiently large shearing force, it is possible to separate the portion of the ink layer to be transferred from the remaining portion of the ink sheet 14.

In the embodiment of the invention as described hereinbefore, all the lines are recorded at a constant speed, so that the rate at which ink is transferred onto the recording paper may be kept constant for all of the lines which are printed. This enables both the recording paper 11 and the ink sheet 14 to be fed at constant speeds and, therefore, allows the use of simplified feed systems and feed controls. These simple feed controls make it easy to develop a high relative speed between the recording paper and the ink sheet.

An example of an ink sheet suitable for use in the present invention will be described with reference to FIG. 23, which is a sectional view of the ink sheet.

Figure 23:
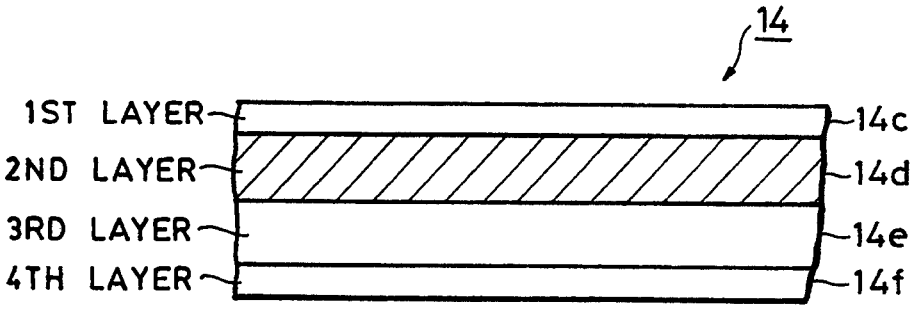
FIG. 23 is a sectional view of a multi-print ink sheet used in an embodiment of the present invention.

As will be seen from FIG. 23, an ink sheet 14 suitable for use in a multi-print image recording apparatus according to the present invention has a four-layered structure.

The second layer is the base film which serves as the carrier for the entire ink sheet 14. The multi-print ink sheet is subjected to repeated use and, hence, repeatedly experiences the application of heat energy. The base film 14*d*, therefore, is preferably made from a material having a high resistance to heat, such as an aromatic polyamide film or a capacitor paper, although conventionally-used polyester films can be used without problem. The thinner the base film the higher the quality of the printed image which can be obtained. Conversely, too thin a base film will reduce strength of the ink sheet. To satisfy the competing demands for printing quality and strength, the thickness of the base film is preferably selected to fall within the range of 3 to 8 $\mu$m.

The third layer 14*e* is an ink layer of thickness sufficient to enable ink to be transferred a number of times (n) from a given region of the ink sheet to the recording paper. Major components of the ink include a bonding agent which is a resin such as EVA, a coloring agent or dye such as carbon black or nigrosine, and a binding agent such as carnauba wax. These components are prepared and mixed in a manner which will enable each portion of the ink sheet to undergo n-times of use. Preferably, the amount of the ink held on the ink sheet ranges from 4 to 8 g/m$^2$. The amount of the ink held by the ink sheet, however, may be selected in any manner which will allow the ink sheet to provide a desired sensitivity or image density.

The fourth layer 14*f* is a top coating layer which serves to prevent the undesirable transfer of the ink which can be caused when the third layer is pressed against to the recording paper. This layer is made of, for example, a transparent wax. In operation, only the fourth layer 14*f* will be transferred by this pressure. Thus, the ink will never be transferred unless it is melted by application of heat. It is therefore possible to prevent contamination of the background portion of the recording paper.

The first layer 14*c* is a heat-resistant layer which protects the second layer 14*d* (base film) from the heat applied by the thermal head 13. This layer 14*c* is most useful used in the case of multi-printing, where there is a possibility that thermal energy in an amount sufficient to melt the ink will be applied at once to a particular portion of the ink sheet, as is the case where there is continuous printing of black information. The use of this heat-resistant layer, however, is not essential. This layer 14*c* provides an appreciable benefit particularly when the base film is made from a material having a comparatively low heat resistance value.

The construction of the ink sheet explained in connection with FIG. 20 is only illustrative. For instance, the ink sheet may be composed of a base layer and a porous ink retention layer containing the ink and which is provided on one side of the base layer. The ink sheet also may be of a type having a base film and a microporous network structure disposed on the base film, this network structure being impregnated with ink. Various materials can be used to form the material of the base film, such as, for example, polyamide, polyethylene, polyester, polyvinyl chloride, triacetylcellulose or nylon. It is also possible to use a paper sheet for the material of the base film. Other materials such as silicone resin, epoxy resin, fluoric resin and ethylcellulose can also be be used as the material of the base film.

In the embodiment described hereinbefore, the supply of the recording energy supply is controlled such that more recording energy is supplied to record the initial line of a data block and less recording energy is supplied when the information of the last line is recorded. This, however, is only illustrative and may be modified so that, for example, the recording energy is increased for a number of lines starting from the initial line and is reduced for a number of lines ending with the last line of the block.

That is, the rate at which recording energy is supplied may be controlled and varied in accordance with the order or position of each line in a line block composed of a number of lines, during recording of such lines at the same constant speed. The described method of heat control also is illustrative. For instance, it is possible to control the heat energy supply rate so that more heat energy is supplied for the first line and less heat energy is used for printing the second line. It is also possible to control the heat energy supply rate by another control method, based upon the order or position of the line in a group composed of a plurality of lines, during recording of such lines at the same constant speed.

It will be appreciated that the present invention not only prevents degradation of the image quality and sticking of paper but also offers various advantages derived from the simplified control which is based upon the order or the position of the line, i.e., simplification of various other controls performed in the apparatus.

It is also to be noted that an image forming apparatus designed in accordance with the present invention can employ various types of recording heating systems, such as, for example, the electrical power supply type or laser transfer type, as well as the thermal head type system described hereinbefore. Although the described embodiment employs a thermal line head, the invention can be realized in various other forms such as, for example, the so-called serial-type thermal transfer printer. Although the invention has been described with specific reference to a multi-print type apparatus, it will be clear that the invention can equally be applied to image recording apparatuses which use a so-called one-time ink sheets which can only be used once.

Furthermore, the thermal transfer type recording apparatus, which has been described as the printer of a facsimile apparatus, can be used in various machines and apparatuses such as wordprocessors, typewriters and copying machines. Although the above-described described embodiment is based upon a thermal transfer type recording system, it is to be understood that the invention can be applied to a variety of types of image recording devices which use heat energy as the recording energy, such as a recording system employing a heat-sensitive recording paper, and so forth.

The recording medium on which information is to be recorded by the image recording apparatus of the present invention is not limited to the recording paper mentioned in the foregoing description but also includes various other types of recording medium such as cloth, plastics and so forth. The roll-type mechanism for supplying the ink sheet may be recorded with any other suitable system such as a so-called ink sheet cassette having a casing which accommodates an ink sheet and which is detachably mounted on the body of the apparatus.

The invention may be applied to a system which is composed of a plurality of components or machines or to a single apparatus. Obviously, the invention can be realized by adding programs to an existing system or apparatus.

As will be seen from the foregoing description, the present invention makes it possible to record a number of information lines at the same constant speed, so as to simplify various controls which will now have been made complex by the need to avoid degradation of image quality.

For instance, the time interval between the recording cycles for recording successive lines is regulated to maintain a constant time length so as to facilitate the control of application of the recording energy for each line. For the same reason, the motors for feeding the recording paper and the ink sheet are regulated to maintain constant speeds, which prevents any sticking which may otherwise be caused by variations in the speed of these motors. Thus, the present invention offers a remarkable improvement in the quality of the recorded image, while preventing sticking of the ink sheet on the recording paper.

What is claimed is:

1. An image forming apparatus having thermal printing means for printing an image on a recording medium by using heat energy, comprising:

memory means for storing printing information containing print data representing a predetermined number of lines to be printed, said printing information being stored on a basis of a first speed at which said print data is input and a second speed at which print data for one line is printed;

feeding means for feeding at least said recording medium; said feeding means being disposed in said thermal printing means; and data output means for providing output print data read out from said memory means on a line basis at a predetermined time interval between successive lines and for delivering said output print data to said thermal printing means.

2. An image forming apparatus according to claim 1, wherein said apparatus is a facsimile apparatus and said printing means further comprises a thermal transfer printing means for printing, wherein:

said memory means stores a predetermined number of lines of dot data of received printing information, based on a conversion speed at which said received printing information is converted into said dot data and said second speed at which the dot data for one line is printed;

said feeding means generates a predetermined relative speed between said recording medium and an ink sheet disposed adjacent thereto in said thermal transfer printing means; and said data output means outputs said dot data read from said memory means on said line basis at said predetermined time interval between said successive lines and delivers said dot data which has been output to said thermal transfer printing means.

3. An image forming apparatus according to claim 1 or 2, wherein said memory means further comprises at least two data storage means for storing a predetermined amount of line data, and data input/output means for alternately inputting data to and outputting data from said at least two data storage means according to every said predetermined amount of line data.

4. An image forming apparatus according to claim 2, wherein said predetermined time interval required for said data output means to output one line of said dot data is set to a minimum time required for transmission of said received information.

5. An image forming apparatus according to claim 3, further comprising:

counting means for counting an amount of line data which has not yet been output from said data storage means; and energy control means for controlling said thermal printing means to apply heating energy in accordance with the amount of line data counted by said counting means.

6. An image forming apparatus according to claim 5, wherein said energy control means increases the energy applied by said thermal printing means when the amount counted by said counting means is greater than a first value and decreases the energy supplied to said printing means when the number counted by said thermal counting means is less than a second value.

7. An image forming apparatus according to claim 6 wherein said first value is equal to said second value.

8. An image forming method for forming an image on a recording medium, comprising the steps of:

providing thermal printing means for printing said image;

storing printing information containing print data representative of a predetermined number of lines to be printed, said printing information being stored on a basis of a first speed at which said print data is input and a second speed at which said print data for one line is printed;

feeding at least said recording medium; and outputting said print data on a line basis at a predetermined time interval between successive lines and delivering said print data which has been output to said thermal printing means.

9. An image forming method according to claim 8, wherein said method is a facsimile generation method and said thermal printing means further comprises a thermal transfer printing means for printing, and wherein:

said storing step further comprises storing a predetermined number of lines of dot data of received printing information, based on a conversion speed at which said received printing information is converted into said dot data and said second speed at which the dot data for one line is printed;

said feeding step further comprises generating a predetermined relative speed between said recording medium and an ink sheet disposed adjacent thereto in said thermal transfer printing means; and said outputting step further comprises outputting said dot data on said line basis at said predetermined time interval between said successive lines and delivering said dot data which has been output to said thermal transfer printing means.

10. An image forming method according to claim 8 or 9, wherein said storing step includes storing printing information in a memory means, said memory means comprising at least two data storage means for storing a predetermined amount of line data, and data input/output means for alternately inputting data to and outputting data from said at least two data storage means according to every said predetermined amount of line data.

11. An image forming method according to claim 9, wherein said predetermined time interval required for outputting one line of said dot data is set to a minimum time required for transmission of said received information.

12. An image forming method according to claim 10, further comprising the steps of:

counting an amount of line data which has not yet been output from said data storage means; and controlling said thermal printing means to apply heating energy in accordance with the amount of line data counted in said counting step.

13. An image forming method according to claim 12, wherein said controlling step comprises increasing the energy applied by said thermal printing means when the amount counted in said counting step is greater than a first value and decreasing the energy supplied to said thermal printing means when the number counted in said counting step is less than a second value.

14. An image forming method according to claim 13 wherein said first value is equal to said second value.

* * * * *

UNITED STATES PATENT AND TRADEMARK OFFICE

CERTIFICATE OF CORRECTION

PATENT NO. : 5,355,151

DATED : OCTOBER 11, 1994

INVENTOR(S) : YOSHIDA ET AL.

It is certified that error appears in the above-identified patent and that said Letters Patent is hereby corrected as shown below:

ON TITLE PAGE

In [57] ABSTRACT,
Line 3, "on" should read --on a--.

COLUMN 1

Line 30, "each of" should read --each--.

Column 7

Line 14, "step S16" should read --Step S16--.
Line 22, "to be" should read --has been--.

COLUMN 8

Line 33, "SSBFO." should read "SSBF0.--.
Line 39, "<SSBF0LINE" should read --<SSBF1LINE--.

COLUMN 9

Line 5, "<SSBF0" should read --<SSBFO--.
Line 67, the line should be deleted.

COLUMN 10

Line 6, "CSSBF0" should read --SSBF0--.

COLUMN 11

Line 48, "SSBFOFULL" should read --SSBF0FULL--.
Line 49, "SSBF1" should read --SSBFI--.
Line 58, "proces" should read --process--.

UNITED STATES PATENT AND TRADEMARK OFFICE

CERTIFICATE OF CORRECTION

PATENT NO. : 5,355,151

DATED : OCTOBER 11, 1994

INVENTOR(S) : YOSHIDA ET AL.

It is certified that error appears in the above-identified patent and that said Letters Patent is hereby corrected as shown below:

COLUMN 12

Line 32, "consatnt" should read --constant--.
Line 33, "consatnt" should read --constant--.
Line 51, "SSBF0" should read --SSBFO--.
Line 59, "and S206," should read --and S208,--.

COLUMN 13

Line 7, "SSBF0" should read --SSBFO--.
Line 8, "LINEADO0" should read --LINEADO--.
Line 10, "step s228," should read --step S228,--.
Line 14, "(SSBF0" should read --(SSBFO--.
Line 30, "SSBF0" should read --SSBFO--.
Line 33, "step" should read --steps--.
Line 34, "S252." should read --S250 and S252.--

COLUMN 15

Line 2, "Then, in" should read --Then,--.

COLUMN 18

Line 49, "be be" should read --be--.

COLUMN 19

Line 24, "sheets" should read --sheet--.
Line 55, "will" should read --until--.

UNITED STATES PATENT AND TRADEMARK OFFICE

CERTIFICATE OF CORRECTION

PATENT NO. 5,355,151

DATED OCTOBER 11, 1994

INVENTOR(S) YOSHIDA ET AL.

It is certified that error appears in the above-identified patent and that said Letters Patent is hereby corrected as shown below:

COLUMN 20

Line 67, "printing" should read --thermal printing--, and "ther-" should be deleted.

Line 68, "mal" should be deleted.

COLUMN 21

Line 1, "claim 6" should read --claim 6,--.

COLUMN 22

Line 32, "claim 13" should read --claim 13,--.

Signed and Sealed this

Second Day of May, 1995

Bruce Lehman

*Attest:*

BRUCE LEHMAN

*Attesting Officer*

*Commissioner of Patents and Trademarks*